US010623840B2

(12) United States Patent
Peace, Jr.

(10) Patent No.: US 10,623,840 B2
(45) Date of Patent: Apr. 14, 2020

(54) LOUDSPEAKER ACOUSTIC DIVERSITY APERTURE FRAME

(71) Applicant: Harman International Industries, Incorporated, Stamford, CT (US)

(72) Inventor: Paul Wayne Peace, Jr., Springfield, PA (US)

(73) Assignee: Harman International Industries, Incorporated, Stamford, CT (US)

( * ) Notice: Subject to any disclaimer, the term of this patent is extended or adjusted under 35 U.S.C. 154(b) by 0 days.

(21) Appl. No.: 15/918,845

(22) Filed: Mar. 12, 2018

(65) Prior Publication Data

US 2018/0279027 A1 Sep. 27, 2018

Related U.S. Application Data

(60) Provisional application No. 62/476,569, filed on Mar. 24, 2017.

(51) Int. Cl.
*H04R 1/02* (2006.01)
*H04R 1/34* (2006.01)
(Continued)

(52) U.S. Cl.
CPC ..... *H04R 1/025* (2013.01); *H04R 1/345* (2013.01); *H04R 7/04* (2013.01); *H04R 1/023* (2013.01);
(Continued)

(58) Field of Classification Search
CPC . H04R 1/36; H04R 1/023; H04R 1/30; H04R 1/345; H04R 2201/34; H04R 1/24;
(Continued)

(56) References Cited

U.S. PATENT DOCUMENTS 4,619,342 A * 10/1986 Buck ..... H04R 9/063 181/144
7,178,629 B2 * 2/2007 Vincenot ..... H04R 1/30 181/185
(Continued)

FOREIGN PATENT DOCUMENTS

EP 1592281 A2 11/2005
EP 1781062 A1 5/2007
WO 2010019846 A1 2/2010

OTHER PUBLICATIONS

European Patent Office, Extended European Search Report Issued in Application No. 18161821.6, dated Aug. 1, 2018, Germany, 9 pages.
(Continued)

*Primary Examiner* — Fan S Tsang
*Assistant Examiner* — Angelica M McKinney
(74) *Attorney, Agent, or Firm* — McCoy Russell LLP

(57) ABSTRACT

Embodiments are disclosed for a loudspeaker for producing directed acoustic vibrations. In some embodiments, a loudspeaker includes an electromagnetic transducer including a diaphragm configured to generate acoustic vibrations. The loudspeaker may further include an aperture frame positioned in front of the diaphragm in a direction of propagation of the acoustic vibrations, the aperture frame covering only a portion of a radiating surface of the diaphragm and having a shape that corresponds to the contours of the diaphragm.

20 Claims, 18 Drawing Sheets

(51) Int. Cl.
*H04R 7/04* (2006.01)
*H04R 9/06* (2006.01)

(52) U.S. Cl.
CPC ..... *H04R 9/06* (2013.01); *H04R 2201/02* (2013.01); *H04R 2400/11* (2013.01)

(58) Field of Classification Search
CPC ... H04R 7/04; H04R 9/06; H04R 1/26; H04R 9/022; H04R 1/025; H01S 3/10053
See application file for complete search history.

(56) References Cited

U.S. PATENT DOCUMENTS 8,121,316 B2 * 2/2012 Dodd ..... H04R 1/30 381/186
8,181,736 B2 * 5/2012 Sterling ..... H04R 1/2803 181/176
9,693,141 B2 * 6/2017 Sprinkle ..... H04R 1/345
2002/0106101 A1 * 8/2002 White ..... H04R 9/022 381/400
2004/0170292 A1 * 9/2004 Vincenot ..... H04R 1/345 381/350
2009/0310808 A1 * 12/2009 Button ..... H04R 1/24 381/339
2010/0272295 A1 * 10/2010 Nakatani ..... H04R 1/26 381/160
2017/0048610 A1 * 2/2017 Baird ..... H04R 1/24
2018/0367888 A1 * 12/2018 Baird ..... H04R 1/24

OTHER PUBLICATIONS

"EON 615: 15 Two-Way Multipurpose Self-Powered Sound Reinforcement," JBL Professional Website, Available Online at http://www.jblpro.com/www/products/portable-market/eon600-series/eon615#.Wv2jf-4vxtQ, Available as Early as Jan. 30, 2014, 2 pages.

* cited by examiner

LOUDSPEAKER ACOUSTIC DIVERSITY APERTURE FRAME

CROSS REFERENCE TO RELATED APPLICATIONS

The present application claims priority to U.S. Provisional Application No. 62/476,569 for "LOUDSPEAKER ACOUSTIC DIVERSITY APERTURE FRAME," and filed on Mar. 24, 2017. The entire contents of the above-listed application are hereby incorporated by reference for all purposes.

FIELD

The disclosure relates to electromagnetic transducers and particularly to loudspeakers and aperture frames that alter directivity behavior of sound output by acoustic elements of a loudspeaker.

BACKGROUND

In a transducer, energy of one form is converted to energy of a different form. Electroacoustic transducers convert electrical impulses to acoustic vibrations that may be perceived as audible sound to proximate listeners. Conventional electroacoustic transducers, or speaker drivers, include a conical diaphragm and frame with the magnetic sound-producing components mounted to the small end of the cone, leaving the large end of the cone open. In such configurations, the directivity behavior of the output sound of the transducers may not be uniform above the frequency where the wavelength of the sound is less than the diameter of the radiating surface (e.g., the cone). For example, wavelengths of sound output by a woofer that are much larger than a size of the woofer may be radiated in an omnidirectional manner. However, as the wavelength of the sound approaches the size of the woofer (e.g., a diameter of a cone of the woofer), the sound output of the woofer may be directed in a non-uniform radiation shape. In loudspeakers that include both woofers and high frequency sound components (e.g., a horn), the erratic, non-uniform radiation of sound from the woofers may generate crossover effects that may distort or lower the overall quality of sound output by the loudspeaker.

SUMMARY

Embodiments are disclosed for a loudspeaker for producing directed acoustic vibrations. In some embodiments, a loudspeaker includes an electromagnetic transducer including a diaphragm configured to generate acoustic vibrations. The loudspeaker may further include an aperture frame positioned in front of the diaphragm in a direction of propagation of the acoustic vibrations, the aperture frame covering only a portion of a radiating surface of the diaphragm and having a shape that corresponds to the contours of the diaphragm.

BRIEF DESCRIPTION OF THE DRAWINGS

The disclosure may be better understood from reading the following description of non-limiting embodiments, with reference to the attached drawings, wherein below.

DETAILED DESCRIPTION

Figure 1:
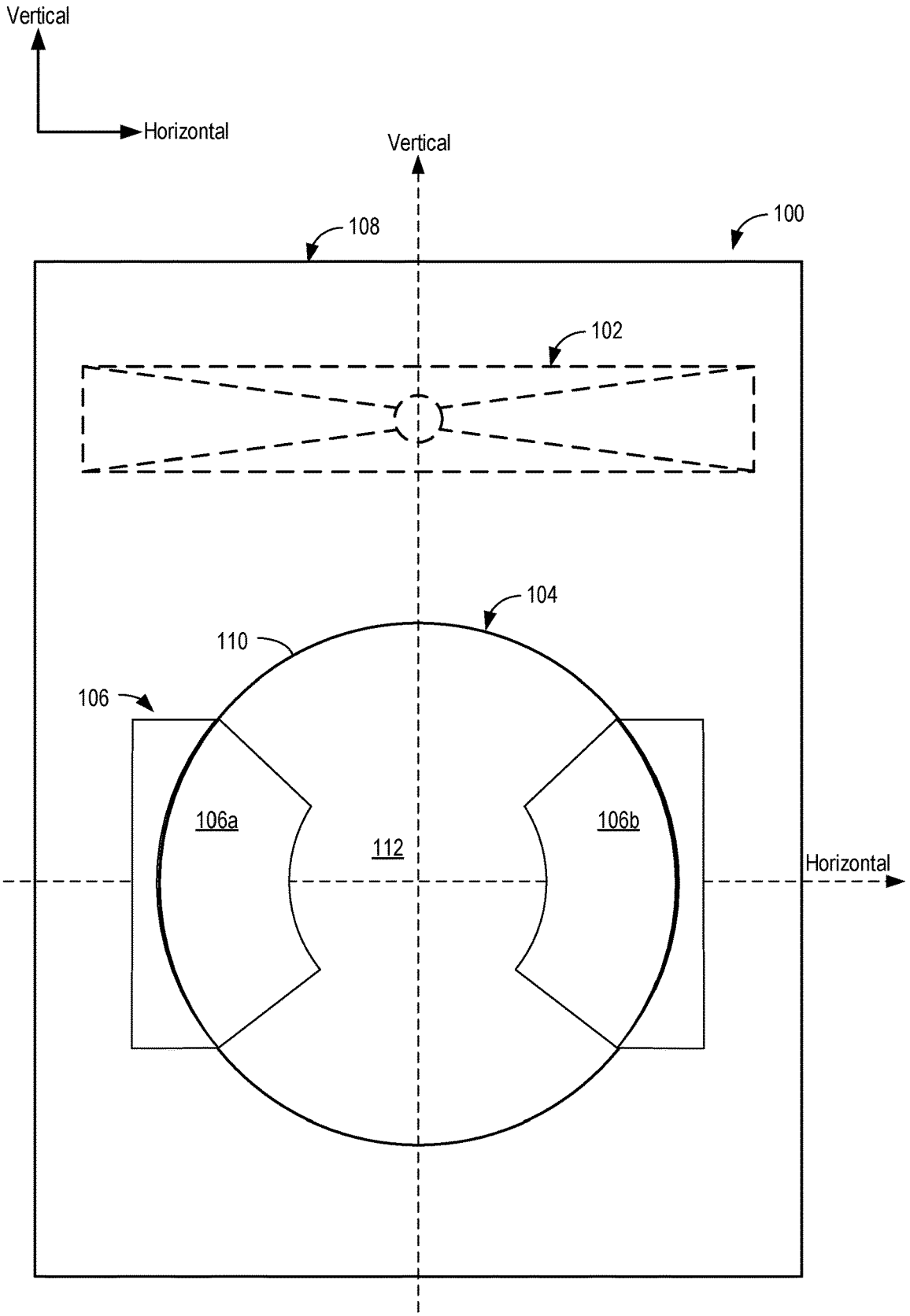
FIG. 1 schematically shows a front view of a loudspeaker with an aperture frame in accordance with one or more embodiments of the present disclosure.

Loudspeakers may be utilized in various sound output environments, including large-scale environments (e.g., arenas, concert halls, theatres, etc.) and small-scale environments (e.g., home theatres/studios, vehicles, etc.). In many environments, listeners may occupy various locations within the environment. In order to minimize the difference between audio experiences in different locations of the environment, sound directivity from loudspeakers may be controlled to a target directivity appropriate to the intended audio system application.

As described above, the ratio between wavelength of output sound and a size of the device outputting the sound (e.g., a diameter of a radiating surface of a moving diaphragm in the loudspeaker) correlates to the directivity of the output sound. In particular, output sounds having a wavelength that is larger than the size of the device are substantially omnidirectional. However, as the wavelength of output sound approaches the size of the device, the directionality of the output sound may change shape, such that sounds output at these relatively smaller wavelengths are perceived differently (e.g., at different decibel levels) in different locations around the loudspeaker. The change in directivity of output sound at different wavelengths may act to emphasize or de-emphasize certain frequencies of sound, or otherwise alter the perception of the overall sound as perceived at different locations relative to the loudspeaker. Further sound distortions may arise as directivity changes in sound output from one device (e.g., a woofer) interact with sounds output from another, more controlled device (e.g., a high frequency horn) to generate crossover.

By at least partially obstructing the radiating surface of a sound-generating device (e.g., a woofer), the radiation shape of output sound (e.g., the directivity of the output sound) may be controlled to create a more omnidirectional sound output. The present disclosure describes example aperture frames that control the radiation shape of output sound of a sound-generating device and mitigate crossover effects in at least one plane of reference (the horizontal plane in the described examples). The aperture frames described herein alter a characteristic of sound produced by the sound-generating device so that the output sound of the sound-generating device is perceived to originate from a radiating surface shaped as a vertical line. For example, the radiating surface of the sound-generating device may be shaped as a circle, and the aperture frames described herein modify sounds output by the circular radiating surface such that the sounds mimic an output of a radiating surface shaped as a vertical line. As a result, the effect of the wavelength-to-device size ratio described above may be reduced.

As will be described below, the aperture frame is configured to hover just above the cone-moving surface of the woofer (e.g., to be positioned in front of an opening of the cone) to block specific areas of the cone from direct radiation (e.g., output). Such an arrangement effectively changes the shape of the perceived acoustic radiation surface from circular (e.g., the shape of the woofer) and raises the pistonic threshold in one plane—in this case, the horizontal plane. The surface of the aperture frame is configured to minimize cavity effects by following the curvature of the woofer (e.g., the woofer cone). Energy (e.g., acoustic waves) directed to or trapped under the aperture frame may be addressed in one or more of the ways described herein, such as dispersion (e.g., venting around the aperture frame, which may be achieved through modification of the fascia/housing or through radiation relief points in a connection point between the aperture frame and housing, the latter of which may be accommodated without further modification of the fascia/housing) and absorption (e.g., collection within an insulation bed in the fascia surface underneath the aperture frame, as shown in at least FIGS. 12-15).

The aperture frame described herein may diffuse the symmetric build up of rim and modal energy on-axis, which exacerbates classic Bessel function pistonic directivity. Such a combination of effects provides an observable increase in directivity control in output regions for a loudspeaker (e.g., a 2-way large woofer system) relative to loudspeakers with no aperture frame (or loudspeakers with differently-configured aperture frames). The aperture frame may also mitigate edge diffraction in the plane of operation, which may be selected to be a dimension for a particular speaker system that experiences the highest (or higher than a threshold) edge diffraction. The aperture frame may be integrated into an overall fascia structure that softens the effect of screen reflection energy (e.g., when used in professional cinema applications) back toward the loudspeaker and increases overall woofer boundary condition compared to other constructions. Accordingly, the aperture frame described herein may provide a floating surface near a direct radiating loudspeaker (e.g., a woofer) that is configured to cause the radiation from the woofer to be more uniform (e.g., relative to a loudspeaker without an aperture frame). The floating surface may be a simple surface that provides at least the following three functions: 1) acts to reshape and resize the effective radiating surface of the driver (e.g., the woofer), 2) acts as a single dimension waveguide for the driver, and 3) acts as a loading plate for the driver. The aperture frame may provide these functions with minimal impact to cost, size, and weight of the loudspeaker.

FIG. 1 schematically shows a front view of an example loudspeaker 100 (which may be referred to herein as a loudspeaker system). In order to output sound in a wide range of frequencies, the loudspeaker 100 may include a plurality of loudspeaker drivers (e.g., of different sizes). A largest size of loudspeaker driver includes woofers, which may reproduce low frequencies (e.g., about 1 kHz or less). A medium-sized loudspeaker driver includes mid-range loudspeaker drivers, which may reproduce middle frequencies (e.g., about 200 Hz to 2 kHz). The smallest size of loudspeaker includes compression drivers, which may reproduce high frequencies (e.g., about 1 kHz or more). The loudspeaker 100 is illustrated with an optional horn 102 and a woofer 104. Similar to the embodiments described in further detail below with reference to FIGS. 4-26, the loudspeaker 100 includes an aperture frame 106 (including aperture frame parts 106*a* and 106*b*) positioned over a larger end of a conical diaphragm of the woofer 104, which is located behind the aperture frame 106 and is therefore partially obscured from view. The woofer 104 is located inside a speaker housing 108 (e.g., a fascia structure), which may optionally also include the horn 102 to produce higher-frequency sounds than the woofer 104.

The woofer may be formed of a conical diaphragm that is positioned adjacent to a front surface of the housing 108. The diaphragm may be a thin, lightweight piece that is usually made of paper, plastic, or metal while the housing (or a frame of the diaphragm that couples to the housing) may be rigid and made of thicker metal relative to the diaphragm in order to provide a support structure for the diaphragm and other speaker components. The diaphragm may be supported by a suspension system to allow the diaphragm to move in an axial direction (e.g., along a central axis of the conical diaphragm) while remaining flexibly connected to the frame/housing. The suspension system may include a rim of flexible material that attaches the diaphragm to the frame/housing near the larger end of the woofer, and corrugated material that is attached to the frame/housing and a voice coil located near the diaphragm. The loudspeaker may have one or more openings to permit air to fill and/or enter an area between the rear of the loudspeaker housing and the rear of the diaphragm. When an electric current from an external source such as an amplifier is passed through the voice coil, an electromagnet is formed that interacts with a permanent magnet surrounding the periphery of the voice coil. The amplifier, or external source, rapidly reverses the electrical signal causing the polarity of the voice coil to rapidly reverse. The rapid reversal of polarity in turn causes the electromagnet and surrounding permanent magnet to interact, thereby forcing the voice coil and attached diaphragm to move back and forth along the axial direction (e.g., a direction of radiation) of the speaker. The movement of the diaphragm vibrates the air in front of and behind the speaker, thereby creating propagating sound waves. Accordingly, the conical diaphragm (e.g., the cone) forms a radiating surface of the woofer. The frequency of the vibrations controls the pitch of the produced sound and the amplitude affects the volume of the produced sound.

The illustrated loudspeaker includes the aperture frame 106 to control the directivity of sound emitted from the loudspeaker. The aperture frame 106 includes a solid, at least semi rigid structure that may be composed of a material that is selected based on the acoustical properties of the speaker. The two parts of the aperture frame 106 may be positioned opposite from one another with respect to a circumferential edge 110 of the woofer 104 to form a vertical shaped opening or orifice 112 (e.g., an aperture opening) through which sound waves outputted from the woofer travel with the least resistance relative to other locations on the aperture frame 106. The aperture frame 106 is a three-dimensional feature with varying depth relative to a front surface (the illustrated surface in FIG. 1) of the housing 108. In particular, the aperture frame 106 curves inward toward an interior of the housing 108 corresponding to a slope of a radiating surface of the woofer (which slopes inward toward the interior of the housing in a uniform manner from the circumferential edge 110 to a center of the woofer 104). Accordingly, the shape of the aperture frame in a direction from the circumferential edge 110 toward the center of the woofer 104 (e.g., a smallest end of a diaphragm cone of the woofer) slopes inward to have an increasing depth relative to the front surface of the housing (e.g., portions of the aperture frame that are closer to the center of the woofer extend further away from the front surface of the housing [toward the interior of the housing] than portions of the aperture frame that are closer to the circumferential edge of the woofer). The slope of the aperture frame may correspond to that of the woofer such that the aperture frame maintains a separation from the woofer (e.g., the portion of the woofer located directly below the aperture frame) within a range of 1 to 2 mm (or some other separation range that accounts for the maximum extension/movement of the woofer to ensure that the woofer does not contact the aperture frame during operation).

A vertical and horizontal axis shown in FIG. 1 defines the position of the aperture frame shape in relation to the woofer diaphragm. It is noted that the axes are arranged to form an origin that coincides with the center of the woofer 104. The aperture frame shape (formed by the two aperture frame parts 106*a* and 106*b*) may form an elongated opening along a vertical axis with a circular central region. In other words, the opening formed by the aperture frame may be wider at a top and bottom region of the woofer than at a center of the woofer along the vertical axis.

The two aperture frame parts 106*a* and 106*b* (and the resulting aperture opening 112) may be substantially mirror symmetrical across the vertical and/or horizontal axis in some examples. In such examples, the center of the aperture opening 112 may substantially coincide with the center of the woofer 104. In other examples, the two aperture frame parts 106*a* and 106*b* may have mirror symmetry across the vertical and/or horizontal axis within a tolerance (e.g., one aperture frame part may be slightly larger or smaller than the other aperture frame part or positioned slightly above or below the other aperture frame part on an opposing side of the woofer). In one example, the tolerance may depend on features of the loudspeaker or tolerances of other components of the loudspeaker, and may range from 0 to 2% difference in size/relative position of the two aperture frame parts. In other examples, more asymmetry may be tolerated, such as a range of 0-5% difference in size/relative position of the two aperture frame parts. Accordingly, the opening 112 may also have a slight asymmetry in such examples in accordance with the above-described tolerance. The two aperture frame parts may cover (e.g., at least partially obstruct in a radiating direction) only a portion of a radiating surface of the woofer (e.g., a radiating surface of the diaphragm). For example, the aperture frame may cover one fourth to one half of a radiating surface of the diaphragm.

Figure 2:
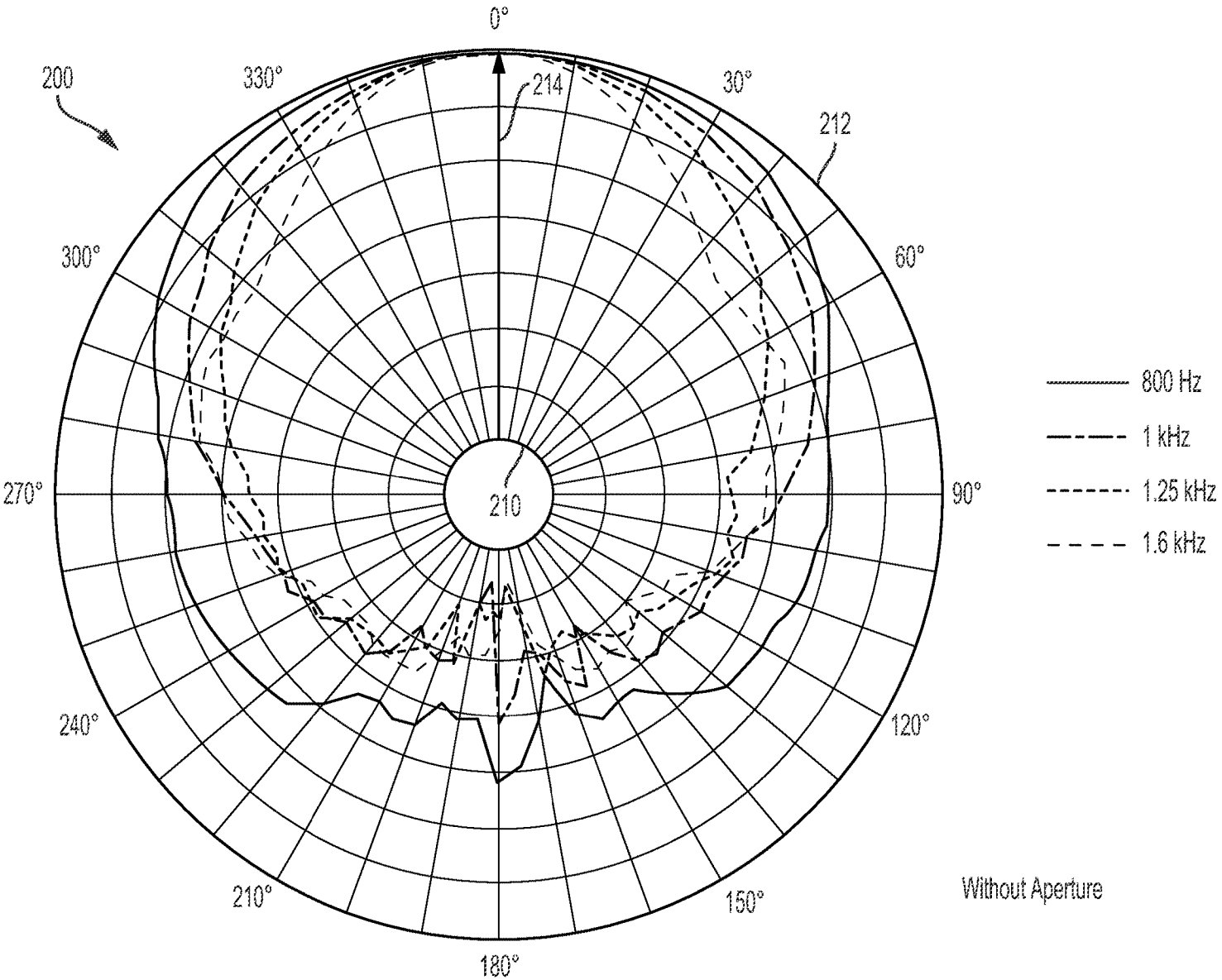
FIG. 2 shows an example horizontal polar plot of sound output for a loudspeaker without an aperture frame.

FIG. 2 shows an example horizontal polar plot 200 showing a decibel level (sound pressure level, dB reference at 20 μPa) of sound output at different frequencies in different radial locations relative to a loudspeaker that does not include an aperture frame according to embodiments of the present disclosure. As shown, the sound output at different radial locations varies widely depending on the frequency of the sound. For example, at a position located 240° relative to the loudspeaker, sounds at 800 Hz have a sound pressure level (relative to reference sound pressure in air) that is well above the sound pressure levels of the 1 kHz, 1.25 kHz, and 1.6 kHz sounds. As another example, at a position that is located 50° from the loudspeaker, each of the frequencies have largely different sound pressure levels. Locations along polar plot 200 that are positioned closer to inner ring 210 indicate decibel levels that are lower relative to locations along polar plot 200 positioned closer to outer ring 212. For example, arrow 214 indicates a direction of increasing decibel levels, with locations along arrow 214 positioned closer to the inner ring 210 (e.g., proximate to a tail of arrow 214) being lower (e.g., at a lesser sound pressure level) than locations along arrow 214 positioned closer to the outer ring 212 (e.g., proximate to a tip of arrow 214).

Figure 3:
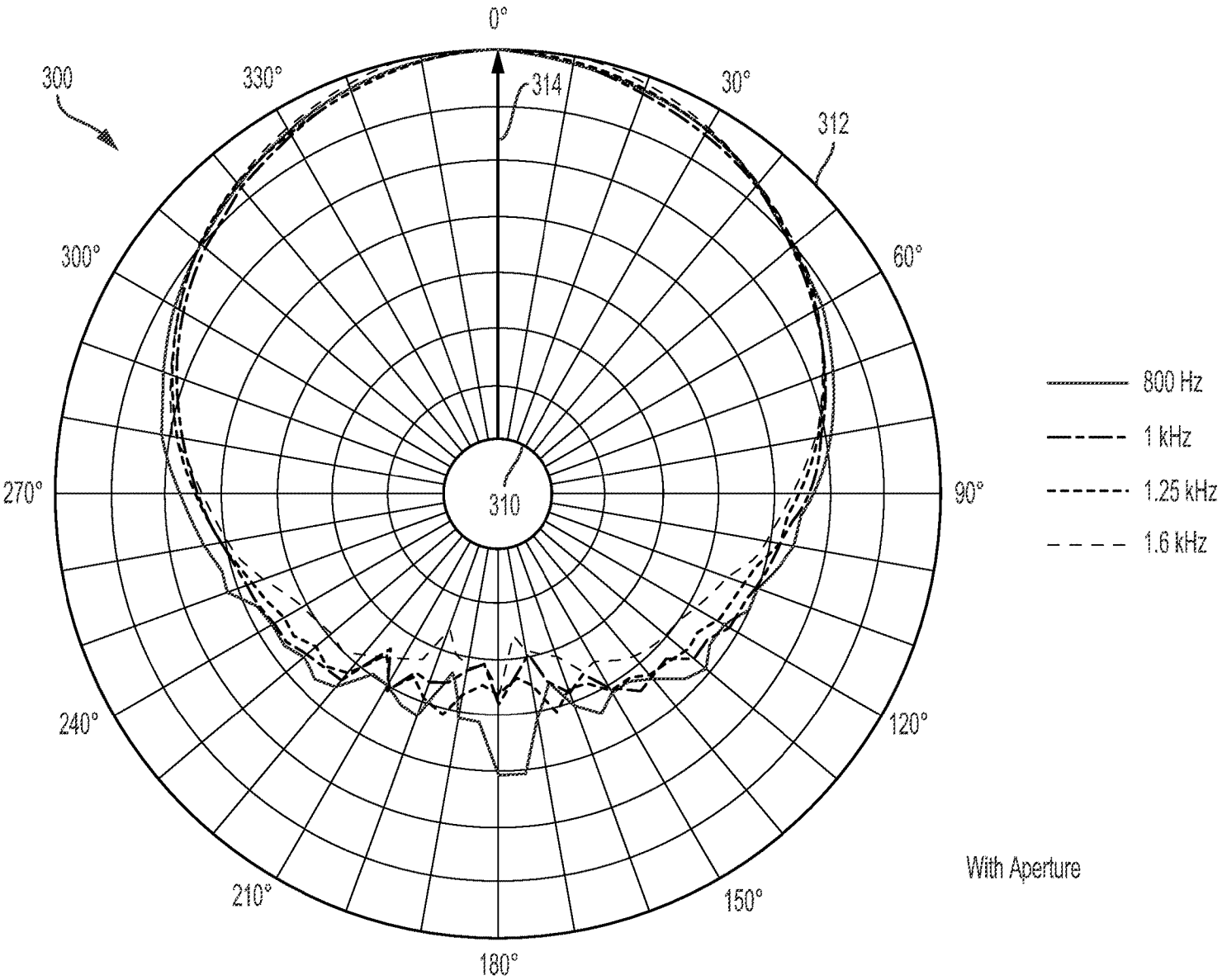
FIG. 3 shows an example horizontal polar plot of sound output for a loudspeaker with an aperture frame in accordance with one or more embodiments of the present disclosure.

Turning now to FIG. 3, an example horizontal polar plot 300 showing a decibel level (sound pressure level, dB reference at 20 μPa) of sound output at different frequencies in different radial locations relative to a loudspeaker that includes an aperture frame according to embodiments of the present disclosure (e.g., similar to aperture frame 106 shown by FIG. 1 and described above, and the aperture frames described below with reference to FIGS. 4-26). As shown, the sound output at different radial locations varies much less than the "without aperture frame" example shown in FIG. 2. For example, at a position located 240° relative to the loudspeaker, sounds at each of the plotted frequencies (800 Hz, 1 kHz, 1.25 kHz, and 1.6 kHz) have nearly the same sound pressure level. A similar comparison of sound pressure levels may be made at the 50° position. In other words, the use of the aperture frame causes sound pressure levels to become more uniform across frequencies and radial positions relative to the sound pressure levels measured for a loudspeaker without an aperture frame. Locations along polar plot 300 that are positioned closer to inner ring 310 indicate decibel levels that are lower relative to locations along polar plot 300 positioned closer to outer ring 312. For example, arrow 314 indicates a direction of increasing decibel levels, with locations along arrow 314 positioned closer to the inner ring 310 (e.g., proximate to a tail of arrow 314) being lower (e.g., at a lesser sound pressure level) than locations along arrow 314 positioned closer to the outer ring 312 (e.g., proximate to a tip of arrow 314).

Figure 4:
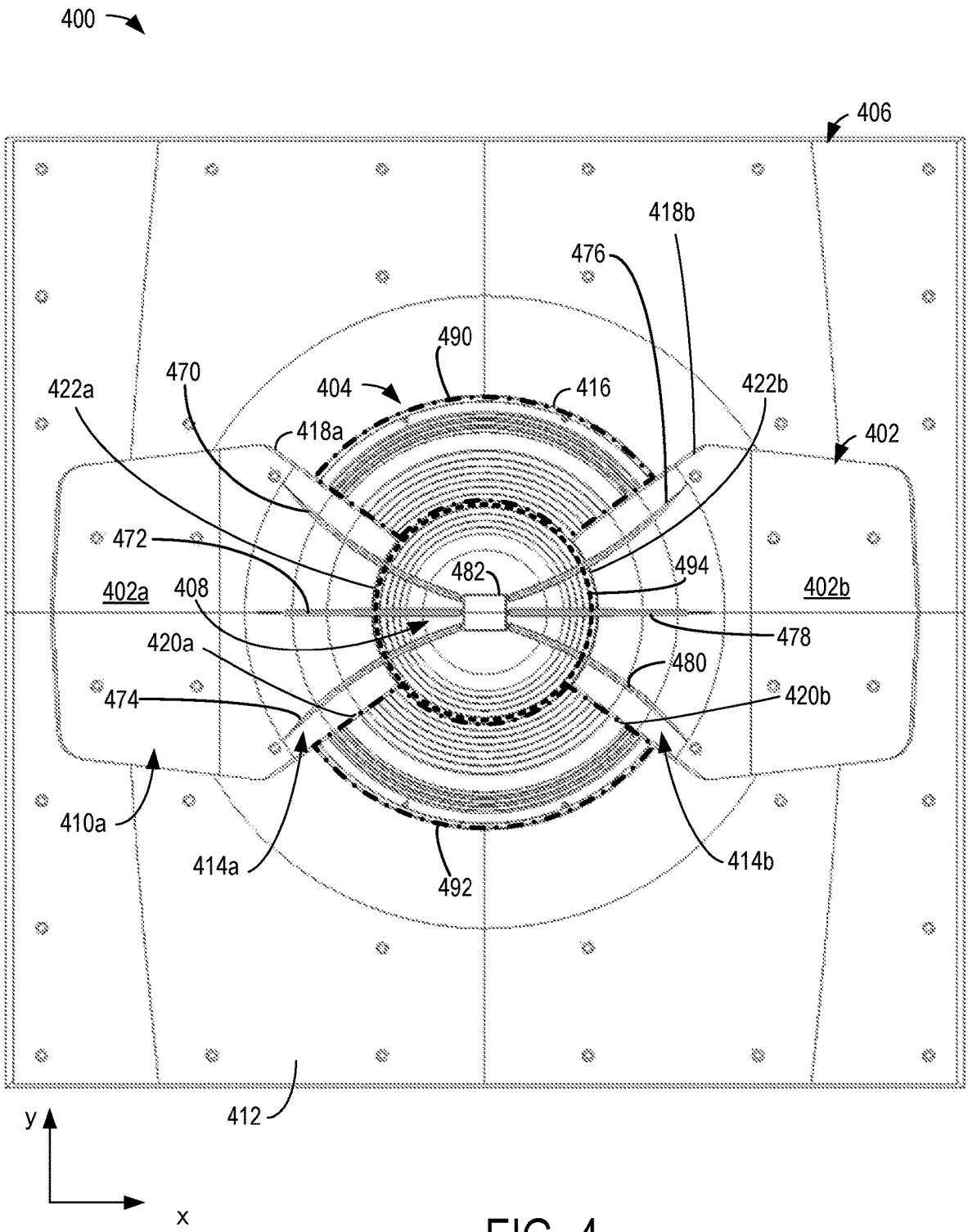
FIG. 4 shows a front view of an example loudspeaker including an aperture frame in accordance with one or more embodiments of the present disclosure.

FIG. 4 shows a front view of an example loudspeaker 400 including an aperture frame 402 positioned over a woofer 404. In FIG. 4, the diaphragm of the woofer 404 is shown, which has a conical structure that recedes inward toward an interior of a loudspeaker housing 406. The aperture frame 402 may be an example of aperture frame 106 of FIG. 1 and/or include any combination of the features of the aperture frames described in this disclosure. The loudspeakers illustrated in FIGS. 4-25 are shown to scale, although other relative dimensions may be used (e.g., depending on the configuration of the loudspeaker system or tolerances of configured components).

Aperture frame 402 includes a pair of aperture frame components 402*a* and 402*b* (which may be symmetrical or asymmetrical within a tolerance, as described above with respect to aperture frame 106 of FIG. 1). In the illustrated example, the aperture frame components are coupled via a bridge 408, which provides additional structural support. In other examples, the bridge 408 may be omitted, or may take on a different shape/configuration. The bridge 408 is configured to include a plurality of fins in order to minimize an effect of the bridge on the radiation of sound from the woofer. For example, as shown by FIG. 4, the bridge 408 includes a first fin 470, second fin 472, third fin 474, fourth fin 476, fifth fin 478, and sixth fin 480, with each of the first through sixth fins being coupled to a central junction 482 positioned in front of the woofer and centered relative to the woofer (e.g., aligned with the center of the diaphragm of the woofer in a direction parallel to the z-axis shown by FIG. 5). Specifically, the first fin 470, second fin 472, and third fin 474 are each coupled to both of the central junction 482 and a sloped portion 414*a* of the aperture frame component 402*a*

(described in further detail below). The fourth fin 476, fifth fin 478, and sixth fin 480 are each coupled to both of the central junction 482 and a sloped portion 414*b* of the aperture frame component 402*b* (described in further detail below). The first fin 470 may curve in a direction away from a center of the woofer (e.g., a center and/or smallest end of the diaphragm cone of the woofer). In one example, the second fin 472 may extend from the central junction 482 to the aperture frame component 402*a* in a direction approximately parallel to a horizontal axis of the loudspeaker 400 (e.g., the x-axis shown by FIG. 4), and the first fin 470 may curve in an upward, vertical direction (e.g., a direction of the y-axis) away from the second fin 472 from the central junction 482 to the aperture frame component 402*a*. The third fin 474 may curve in a downward, vertical direction (e.g., opposite to the upward direction) away from the second fin 472 from the central junction 482 to the aperture frame component 402*a*.

The fifth fin 478 may extend from the central junction 482 to the aperture frame component 402*b* in a direction approximately parallel to the horizontal axis of the loudspeaker 400 (e.g., the x-axis shown by FIG. 4, similar to the horizontal axis shown by FIG. 1, and parallel to the second fin 472), and the fourth fin 476 may curve in an upward, vertical direction (e.g., a direction of the y-axis, similar to the vertical axis shown by FIG. 1) away from the fifth fin 478 from the central junction 482 to the aperture frame component 402*b*. The sixth fin 480 may curve in a downward, vertical direction (e.g., opposite to the upward direction) away from the fifth fin 478 from the central junction 482 to the aperture frame component 402*b*.

Figure 5:
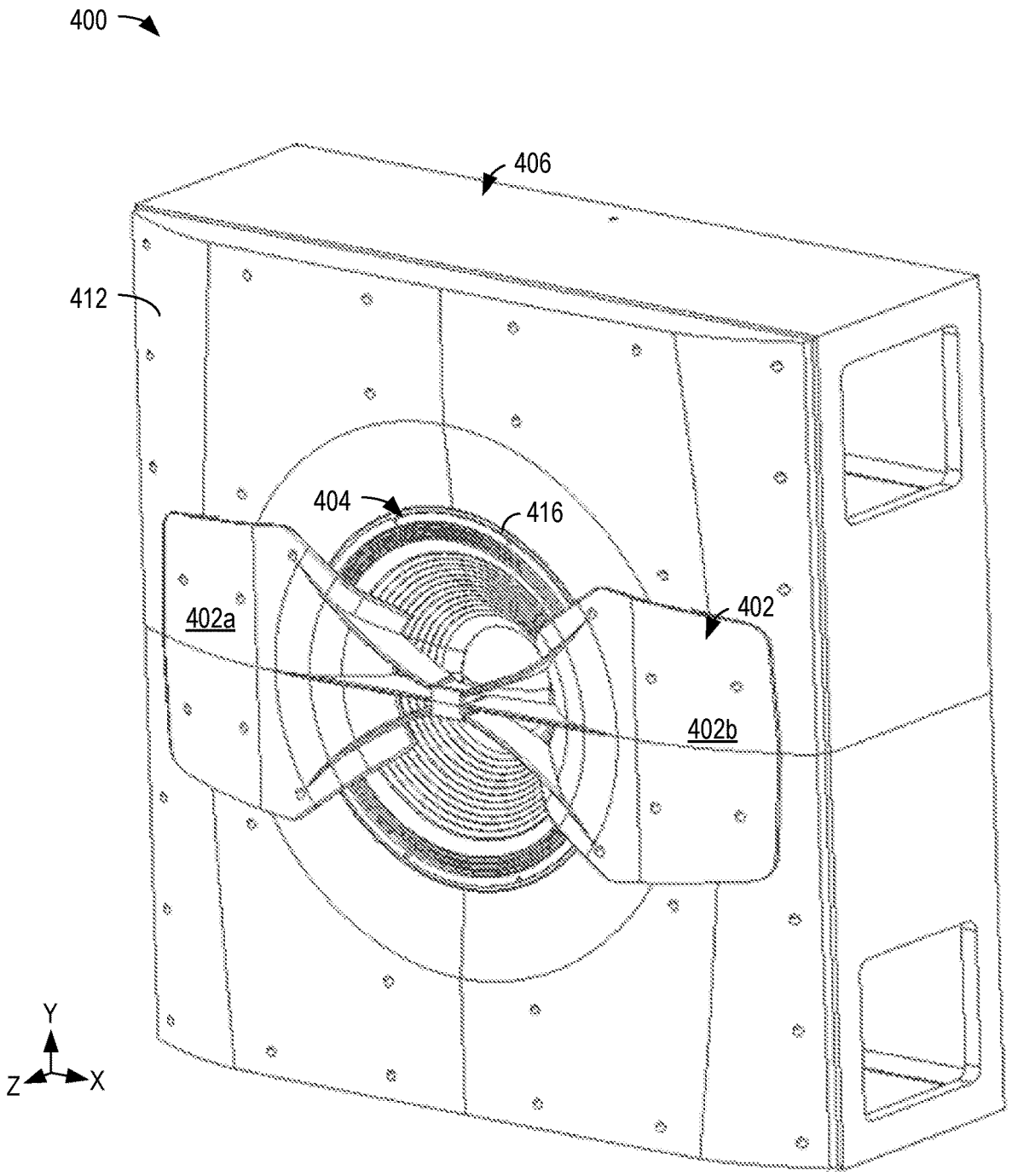
FIGS. 5-9 show different views of the example loudspeaker of FIG. 4.

The fins may be narrower at a woofer-facing surface than an opposing, environment-facing surface in order to direct any impinging sound along the surface of the fins toward the environment in the radiating direction (e.g., the positive z-direction, as shown in FIG. 5).

As the aperture frame components are substantially the same or similar to one another (e.g., mirror symmetric or within a tolerance of mirror symmetry as described above), the features of aperture frame component 402*a* correspond to mirror-symmetric features in component 402*b*. Accordingly, where only features of one of the components is described, it will be understood that mirror-symmetric (or mirror symmetric within a tolerance as described above) features are present in the other of the components, which are labelled with the corresponding "a" or "b" part designation.

Aperture frame component 402*a* includes a base portion 410*a* that is coupled to a front surface 412 of the housing 406. The base portion 410*a* may be in face-sharing contact with the front surface 412 in one or more locations in some examples. In other examples, all or a portion of the base portion 410*a* may be spaced from the front surface 412 (e.g., to accommodate or facilitate flexibility of the aperture frame during operation, or provide an inlet for an insulation bed to absorb radiated energy trapped under the aperture frame during operation). The aperture frame component 402*a* includes the sloped portion 414*a*, which is joined to base portion 410*a* and extends in a direction away from the base portion 410*a*, across (e.g., in front of) a circumferential edge 416 (or a region around the circumferential edge) of the woofer 404 and toward the center of the woofer. Sloped portion 414*a* and sloped portion 414*b* are positioned opposite to each other across the woofer (e.g., positioned at opposing sides of the woofer, in a direction of the x-axis), with each of the sloped portion 414*a* and sloped portion 414*b* extending toward the center of the woofer. The sloped portion 414*a* curves inward (beyond the front surface 412 in a direction toward an interior of the housing 406) toward a center of the woofer in accordance with the curvature of the woofer to maintain a separation between the aperture frame and the radiating surface (the front surface and the only surface of the woofer shown in FIG. 4) during operation.

The sloped portion 414*a* includes first and second edges 418*a* and 420*a* that extend from the base portion 410*a* toward a center of the woofer 404. The first and second edges 418*a* and 420*a* extend toward the center of the woofer at an angle relative to respective first and second edges 418*b* and 420*b* of the aperture frame component 402*b*. Specifically, the first and second edges 418*a* and 420*a* of the aperture frame component 402*a* each converge inward relative to each other in a direction of the center of the woofer (e.g., with the first edge 418*a* being angled in a direction of the second edge 420*a*, and with the second edge 420*a* being angled in a direction of the first edge 418*a*). The first and second edges 418*b* and 420*b* of the aperture frame component 402*b* each converge inward relative to each other in a direction of the center of the woofer (e.g., with the first edge 418*b* being angled in a direction of the second edge 420*b*, and with the second edge 420*b* being angled in a direction of the first edge 418*b*). The sloped portion 414*a* further includes a curved outer edge 422*a* that defines a center-most surface of the aperture frame component 402*a* (e.g., a surface of the aperture frame component 402*a* positioned closest to the center of the woofer). Similarly, the sloped portion 414*b* further includes a curved outer edge 422*b* that defines a center-most surface of the aperture frame component 402*b* (e.g., a surface of the aperture frame component 402*b* positioned closest to the center of the woofer). The curved outer edge 422*a* and curved outer edge 422*b* are positioned opposite to each other across the center of the woofer.

The aperture frame 402 is positioned to create an aperture opening corresponding to regions of the radiating surface of the woofer 404 that are not covered by the aperture frame 402. The aperture opening includes two annular sectors (e.g., topmost annular sector 490 and bottommost annular sector 492) positioned vertically over one another about a central circular region to form a single opening over the woofer. The boundary of the topmost annular sector 490 is formed from the first edges 418*a* and 418*b* and the housing 406 at the portion of the circumferential edge 416 that extends between the first edges 418*a* and 418*b*. The boundary of the bottommost annular sector 492 is formed from the second edges 420*a* and 420*b* and the housing 406 at the portion of the circumferential edge 416 that extends between the second edges 420*a* and 420*b*. A central circular region 494 (e.g., central sector) of the aperture opening is formed between the two annular sectors (e.g., topmost annular sector 490 and bottommost annular sector 492) by the curved outer edges 422*a* and 422*b*. Thus, the boundary of the aperture opening is continuous and uninterrupted, with no other openings for the respective shape.

Figure 6:
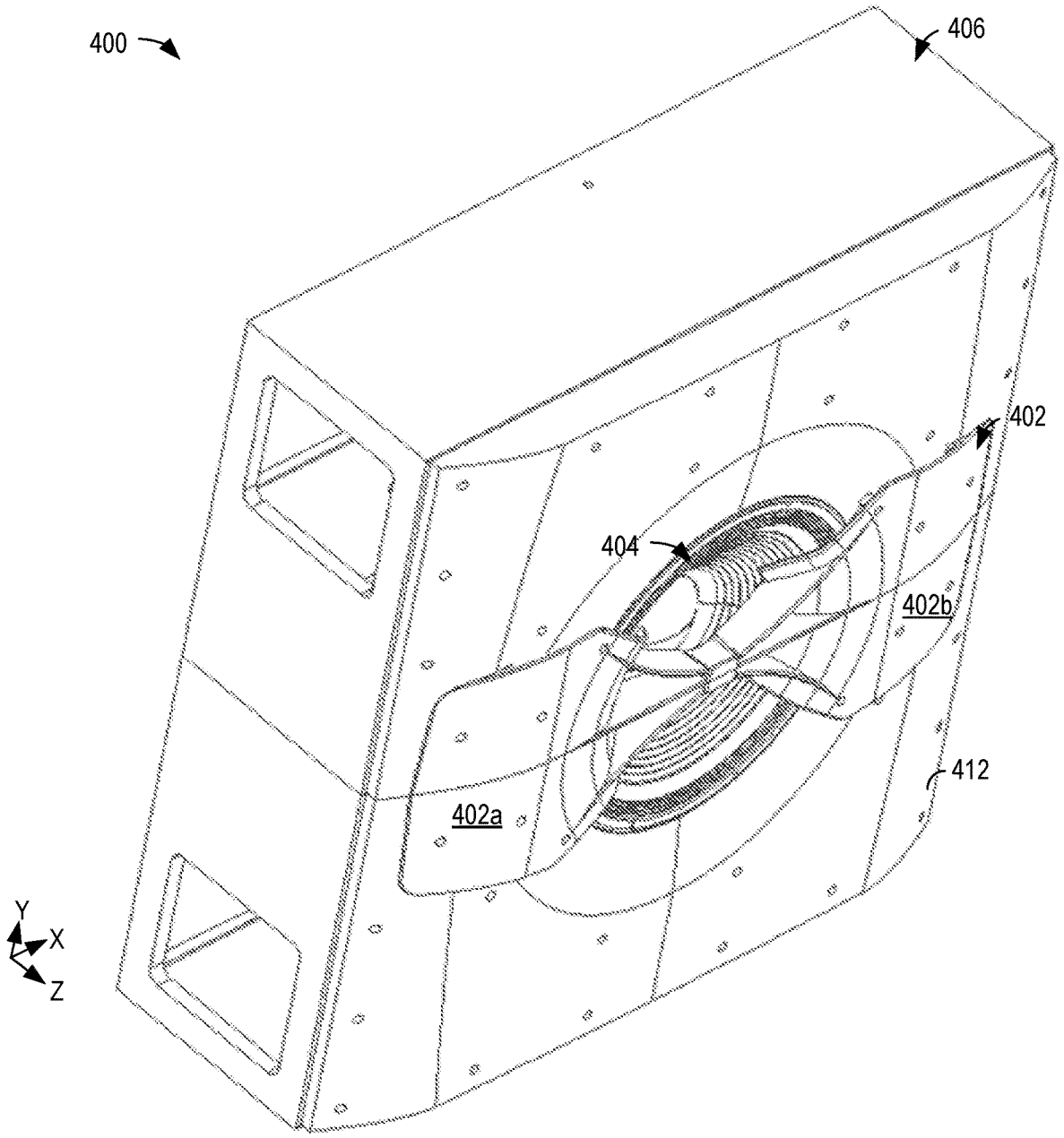
Figure 7:
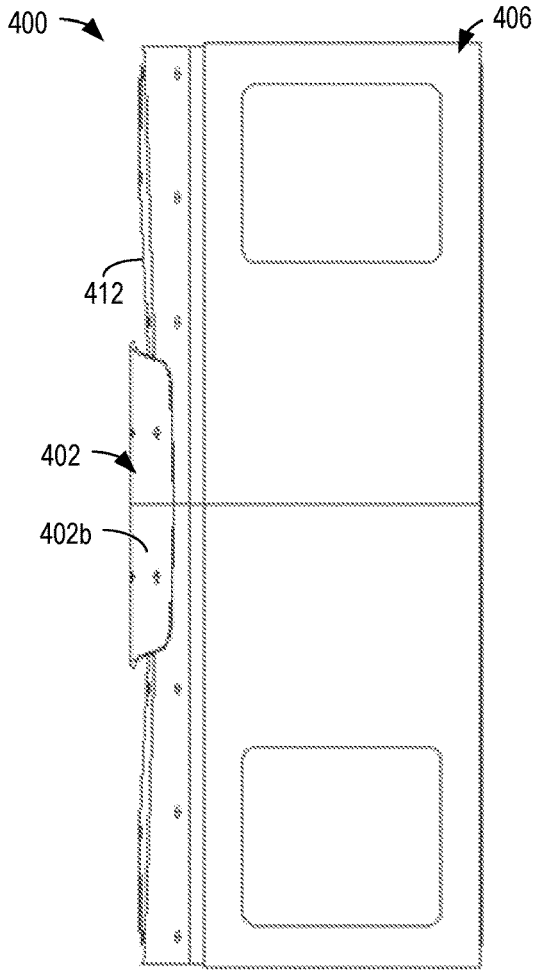
Figure 8:
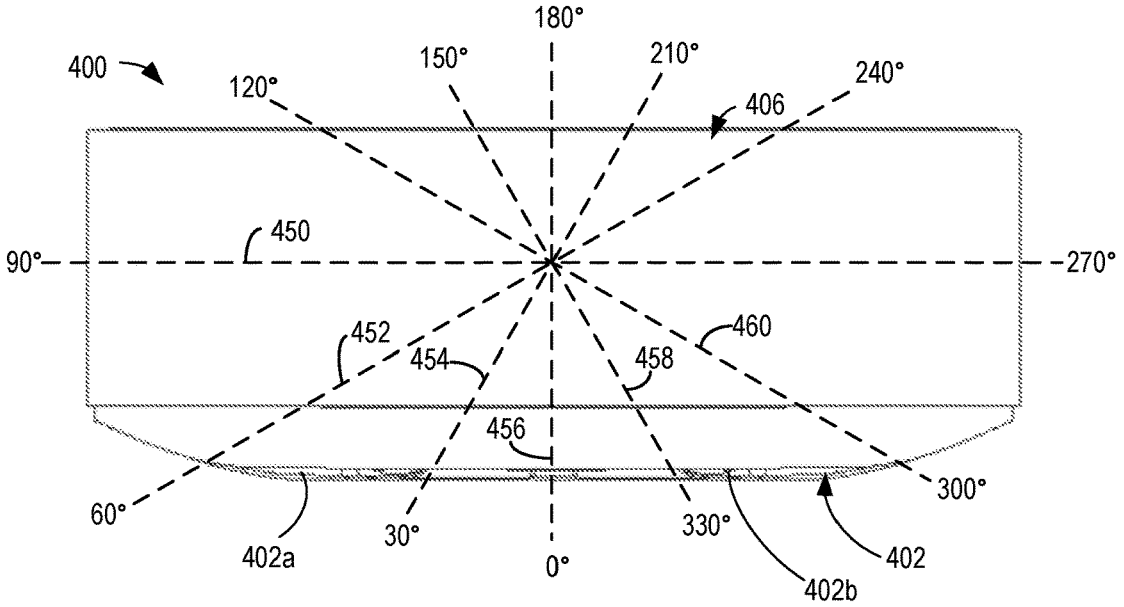
Figure 9:
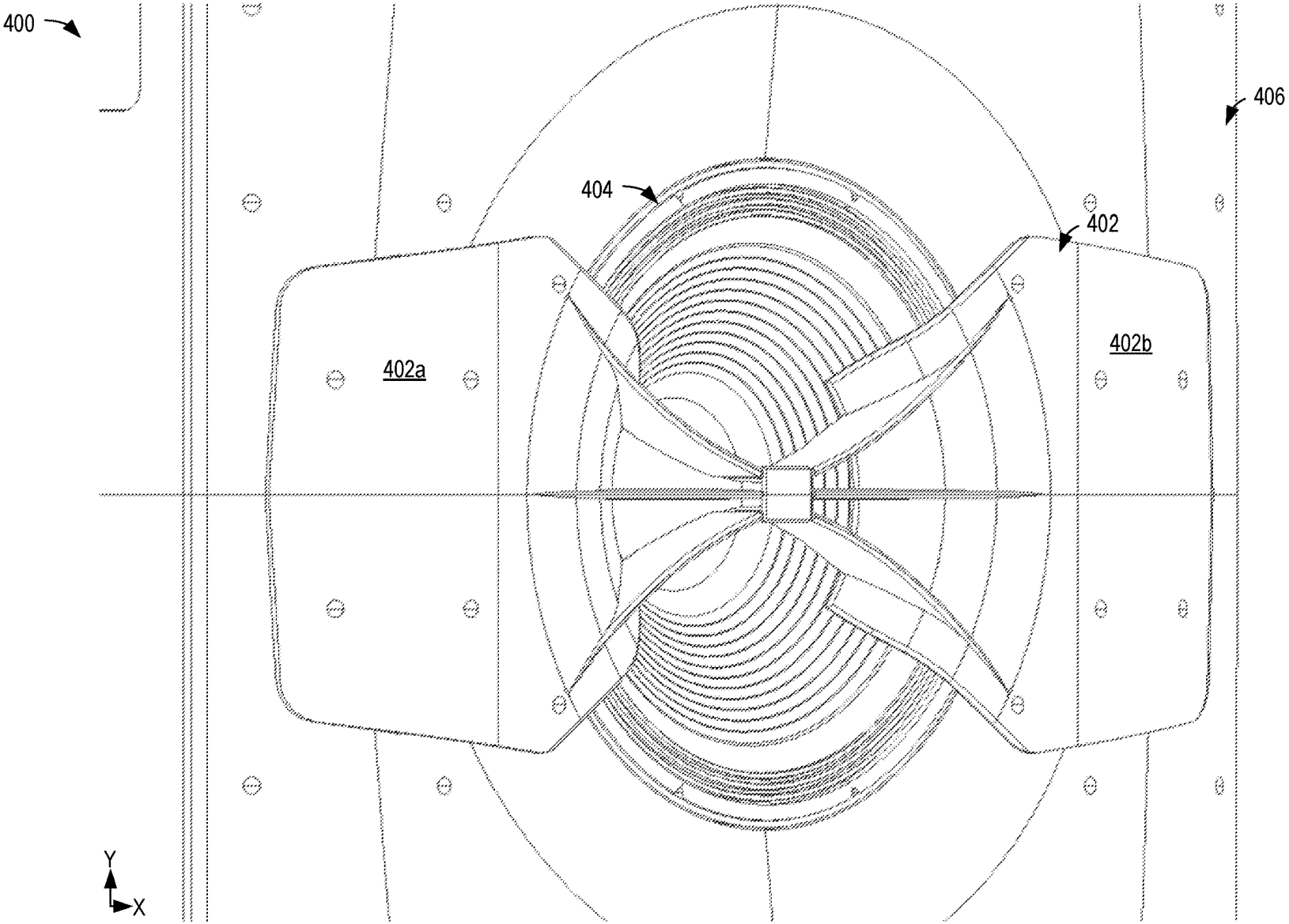

FIGS. 5-9 show different views of the example loudspeaker 400 of FIG. 4. For example, FIGS. 5 and 6 show different projection views of the loudspeaker 400, angled to show the curvature of the aperture frame 402 toward an interior of the housing 406. FIG. 7 shows a side view of the loudspeaker 400, and FIG. 8 shows a top view of the loudspeaker 400. FIG. 8 includes a plurality of axes (e.g., axes 450, 452, 454, 456, 458, and 460) positioned along a horizontal plane of the loudspeaker 400 (e.g., a plane formed by the x-axis and z-axis shown by FIG. 6). The plurality of axes are positioned in a relative arrangement similar to the lines of the polar plot 300 shown by FIG. 3 and described above. Specifically, axis 450 is positioned similar to a line extending through the 90° and 270° marks indicated by polar plot 300, axis 452 is positioned similar to a line extending through the 60° and 240° marks indicated by polar plot 300, axis 454 is positioned similar to a line extending through the 30° and 210° marks indicated by polar plot 300, axis 456 is positioned similar to a line extending through the 0° and 180° marks indicated by polar plot 300, axis 458 is positioned similar to a line extending through the 330° and 150° marks indicated by polar plot 300, and axis 460 is positioned similar to a line extending through the 300° and 120° marks indicated by polar plot 300. In this configuration, decibel levels of sound produced by the loudspeaker 400 may be highest along 456, at a front end of the loudspeaker 400 (e.g., an end including the front surface 412), similar to the decibel levels indicated by arrow 314 shown by FIG. 3. FIG. 9 shows a detailed projection view of the aperture frame 402 of the loudspeaker 400. In the view of FIG. 9, the aperture frame 402 is shown as following the curvature of the woofer 404 toward the center of the radiating surface of the woofer.

Figure 10:
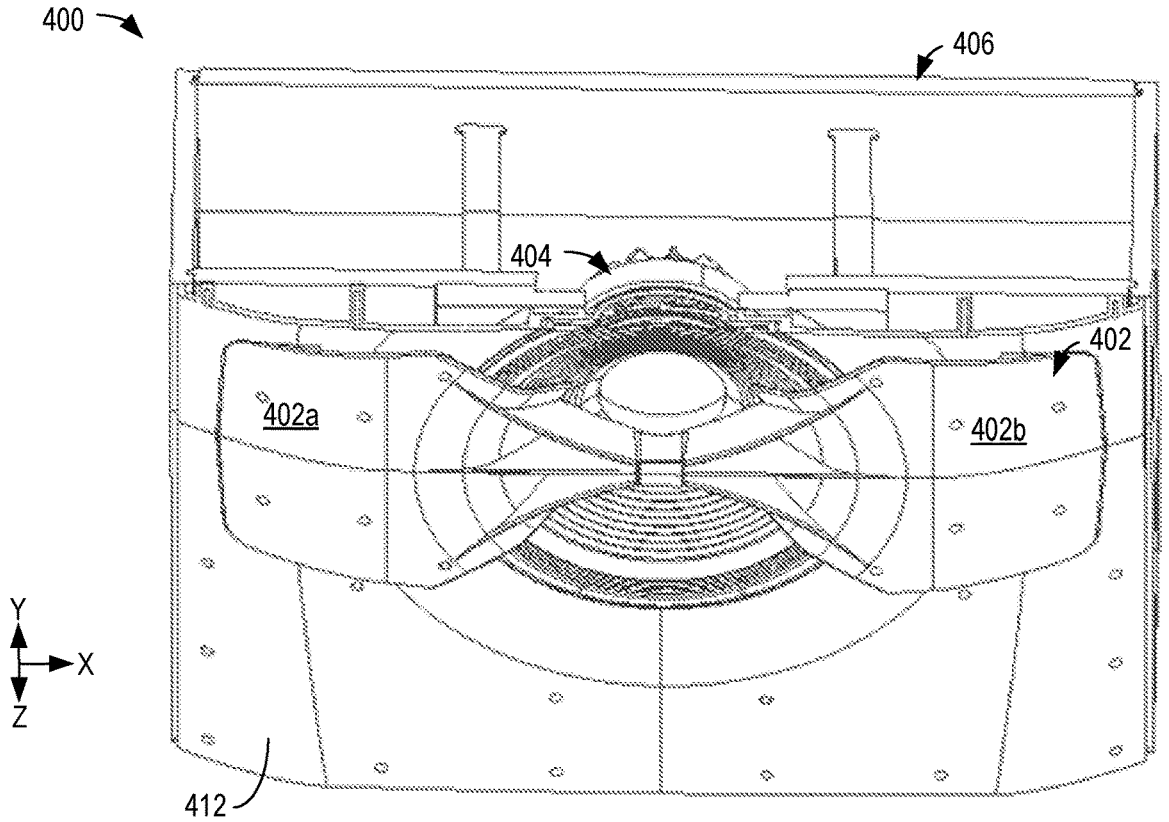
FIGS. 10-17 show different horizontal sectional views of the example loudspeaker of FIG. 4.
Figure 11:
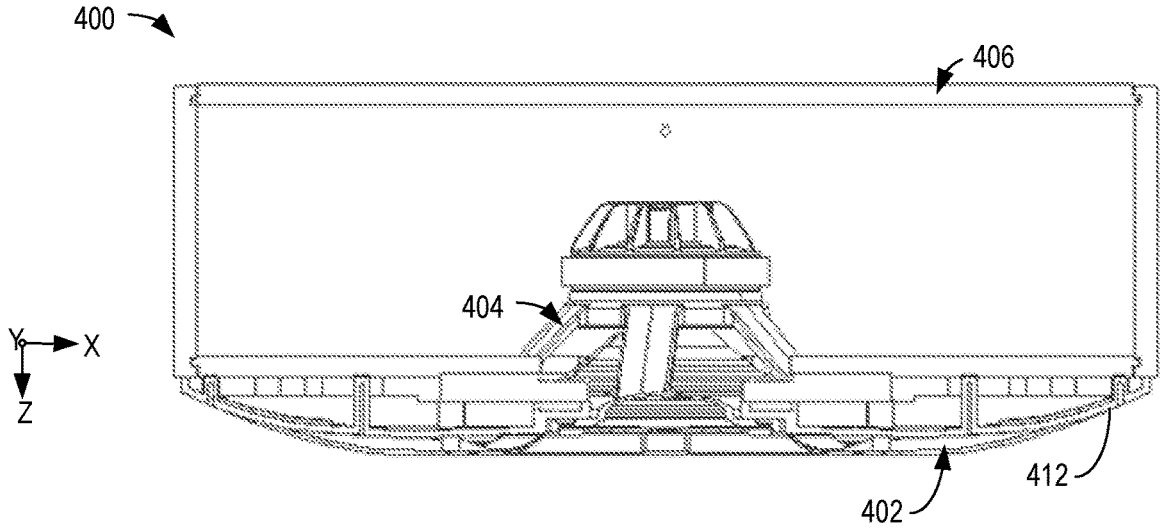
Figure 12:
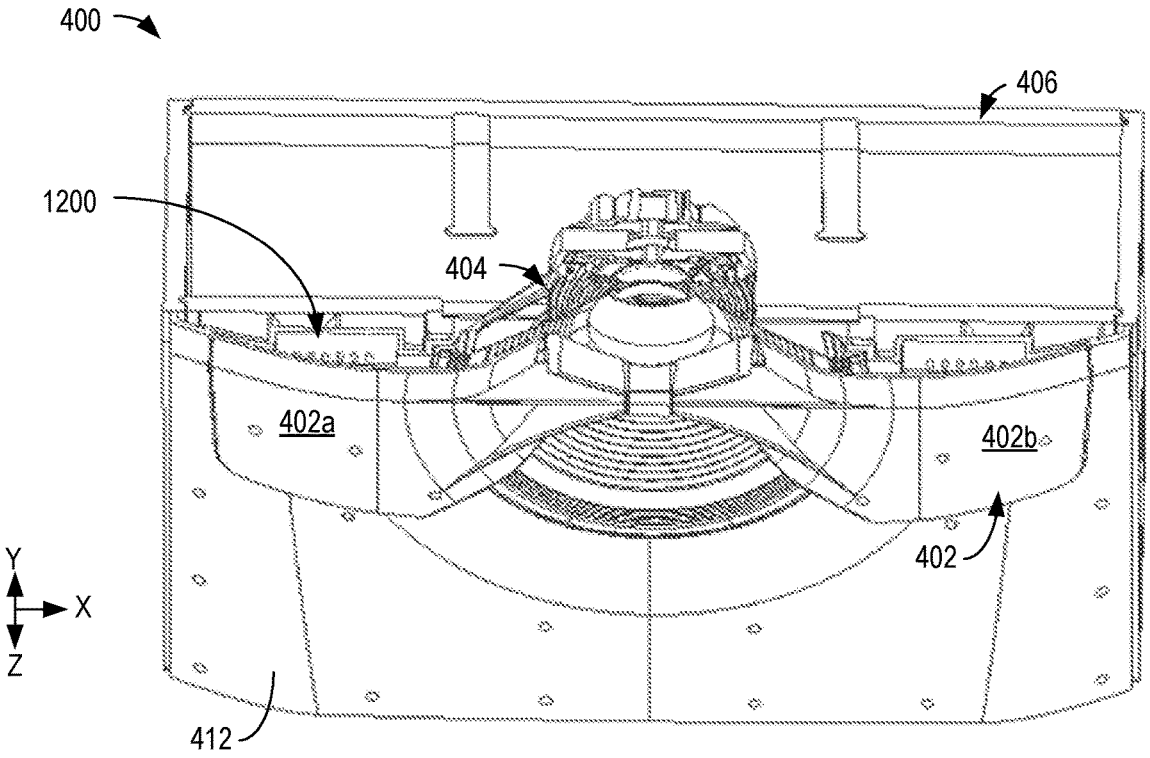
Figure 13:
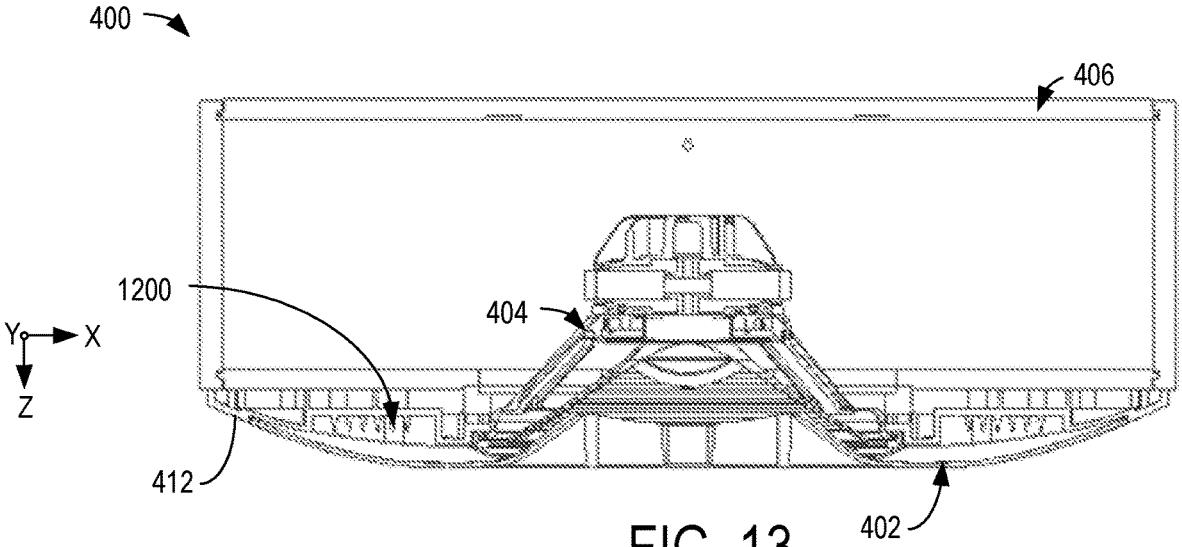
Figure 14:
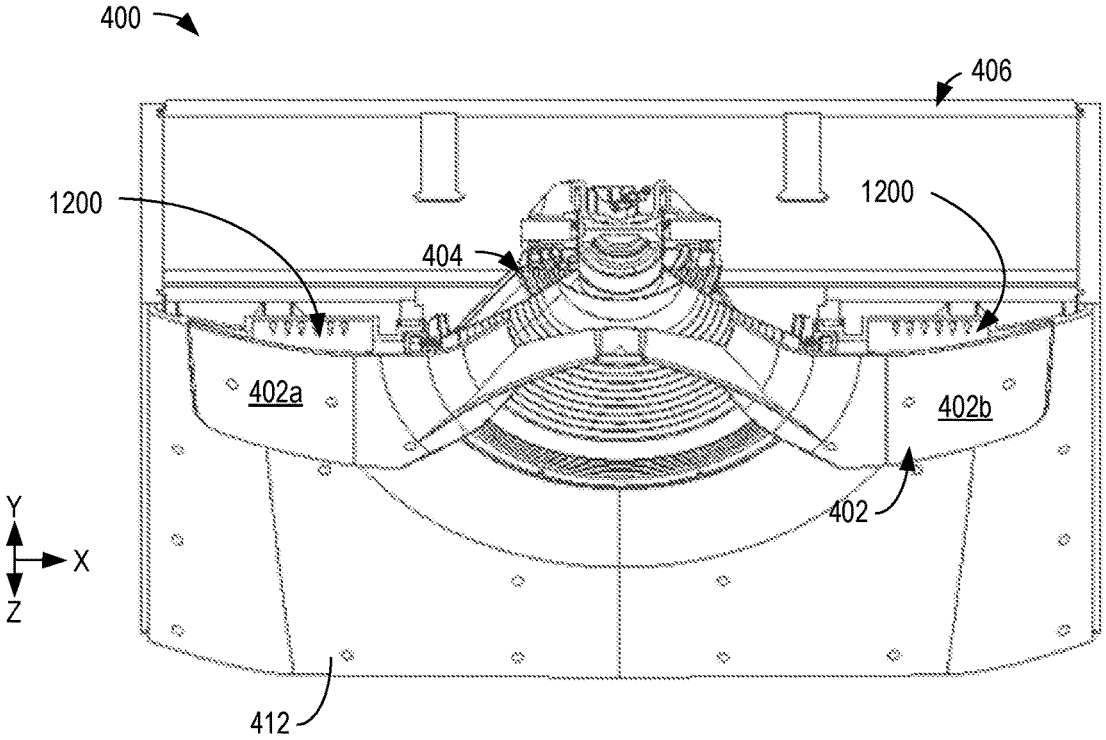
Figure 15:
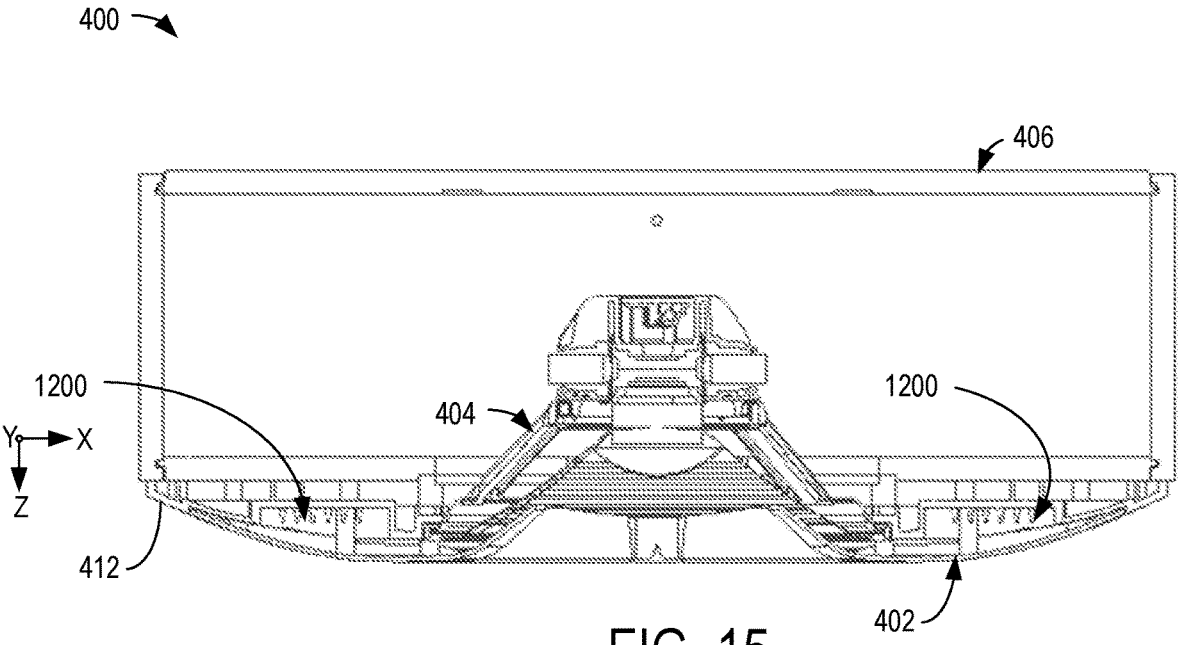
Figure 16:
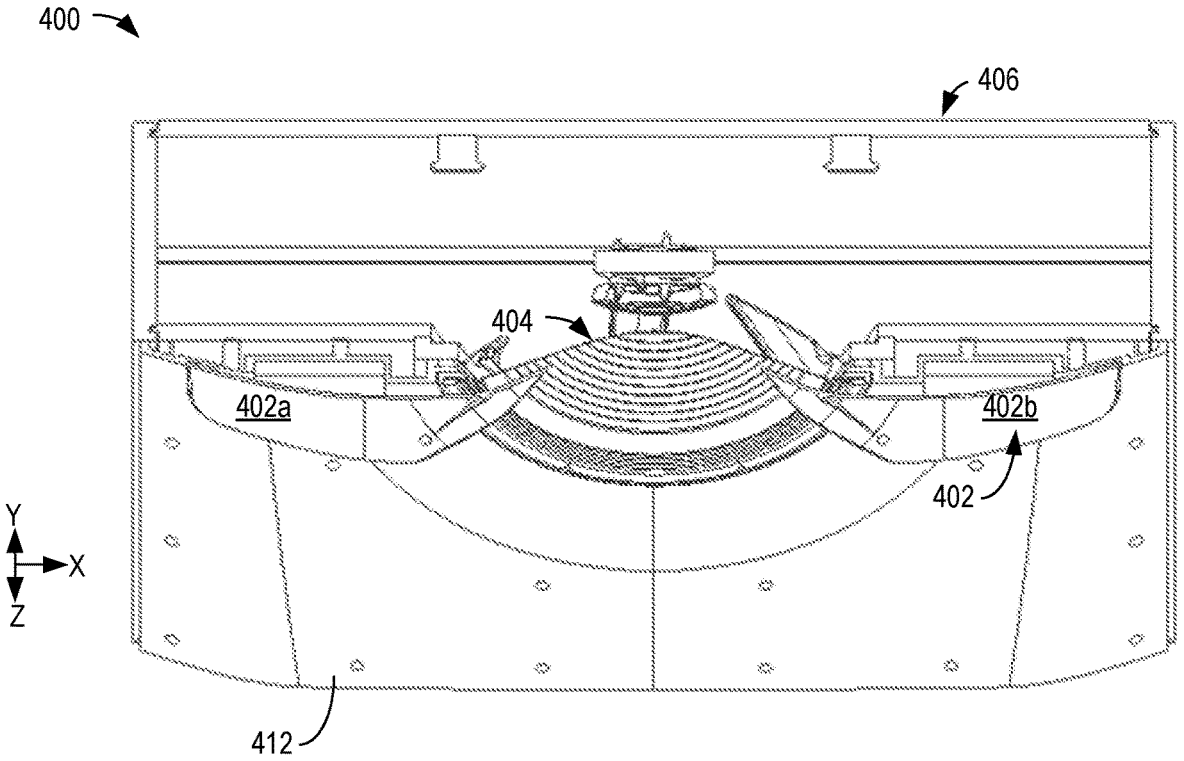
Figure 17:
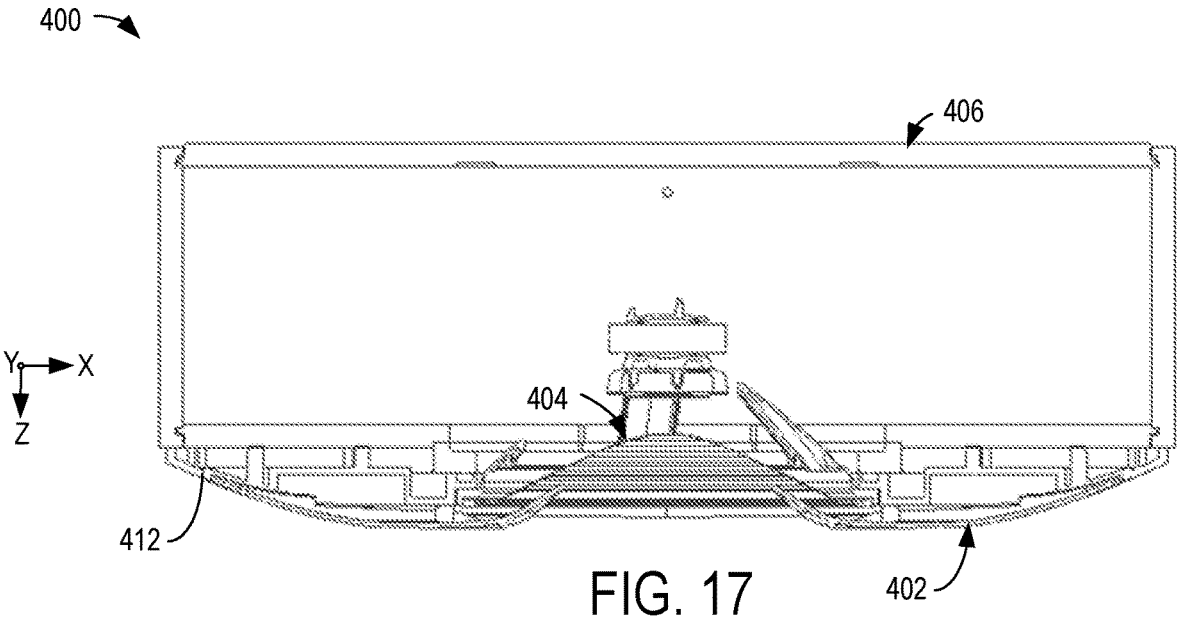
Figure 19:
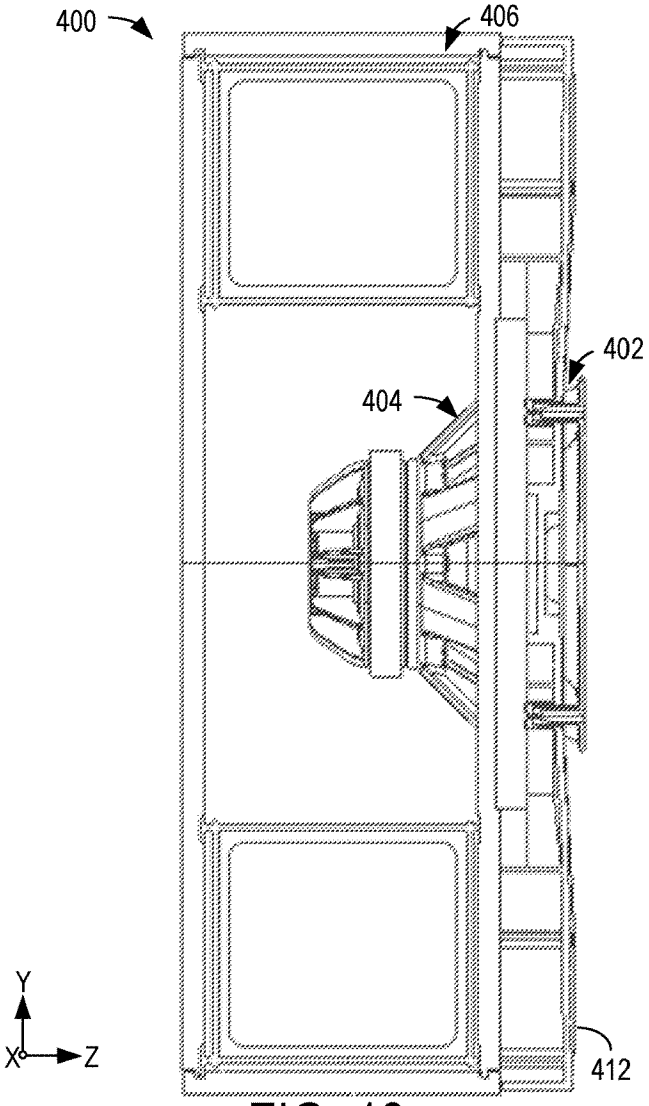
FIGS. 18-25 show different vertical sectional views of the example loudspeaker of FIG. 4.
Figure 18:
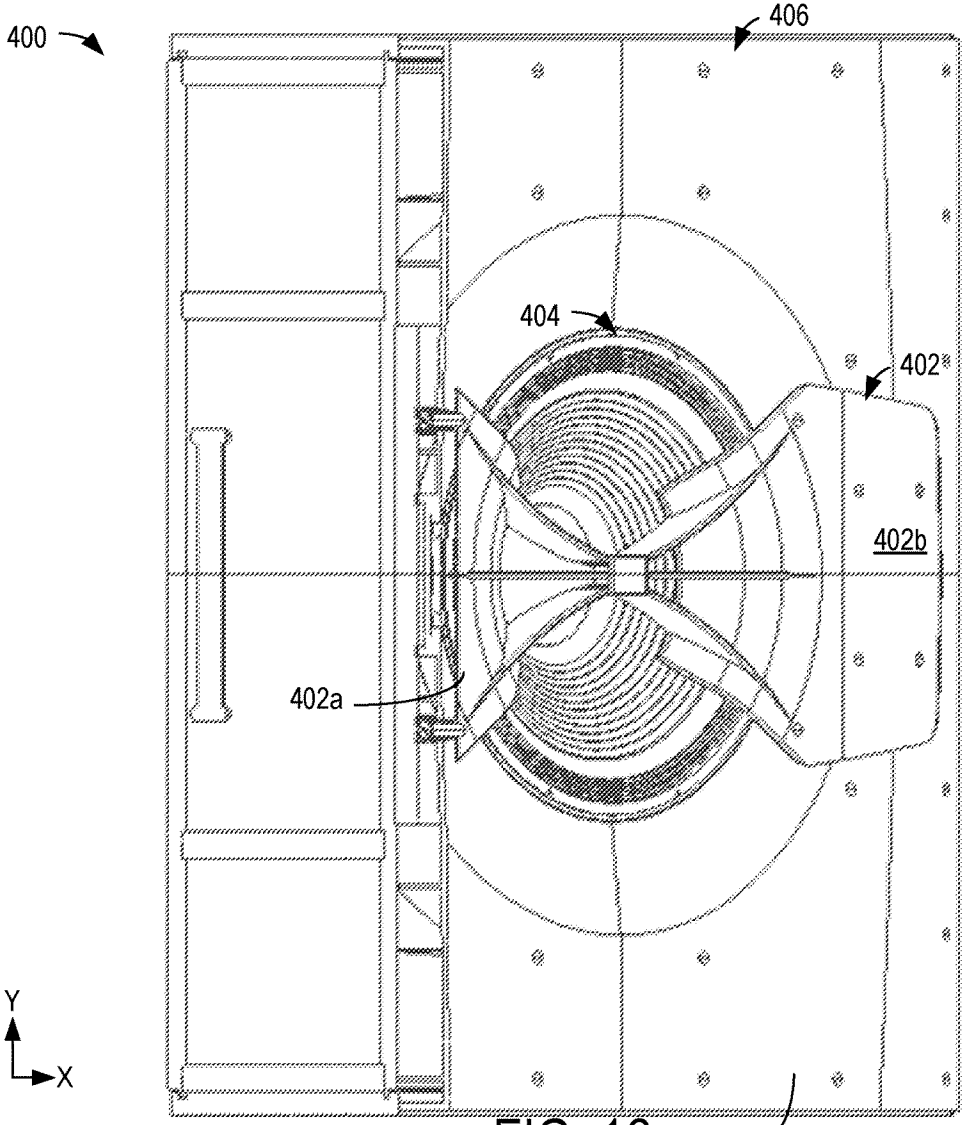
Figure 21:
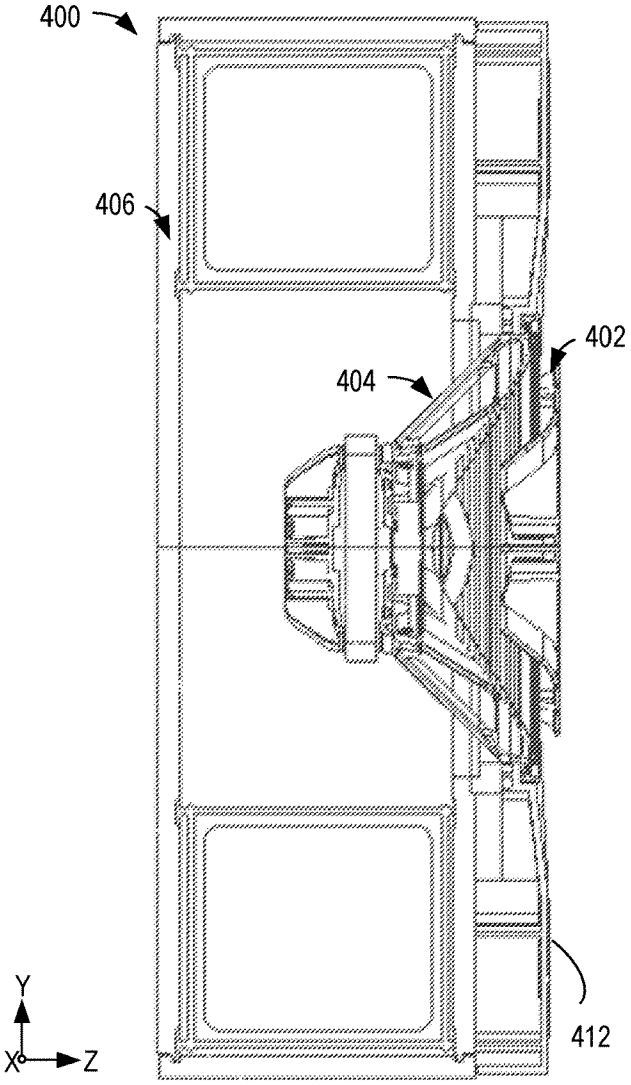
Figure 20:
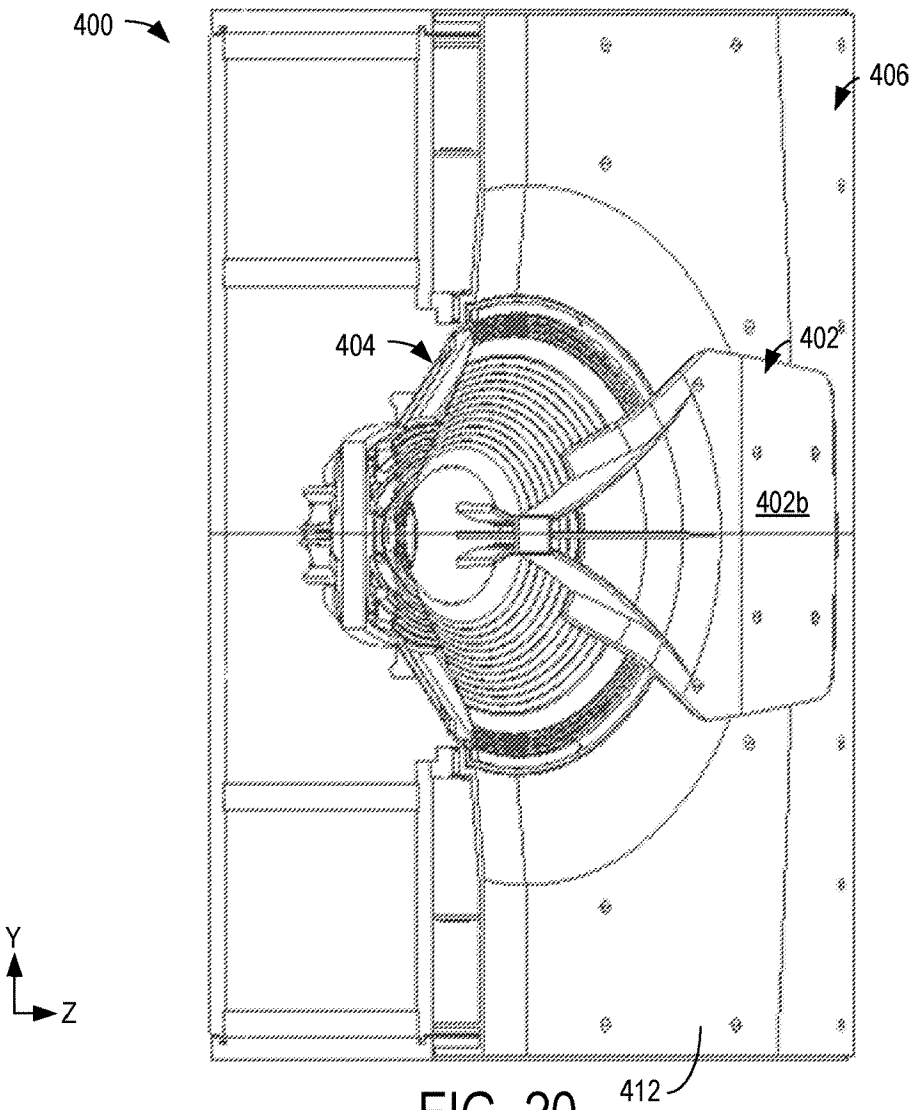
Figure 23:
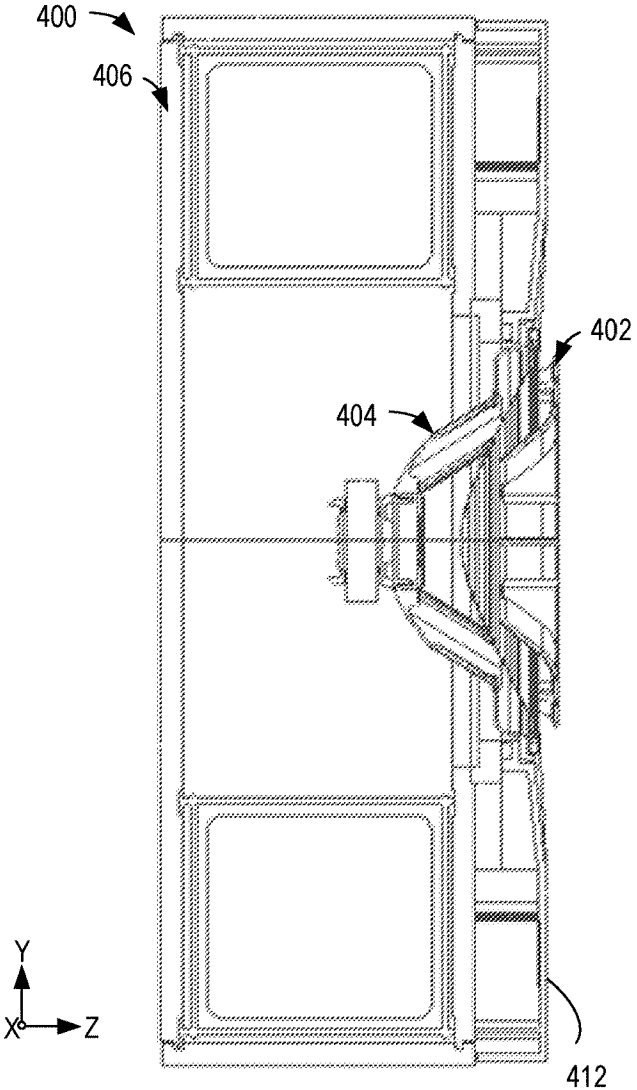
Figure 22:
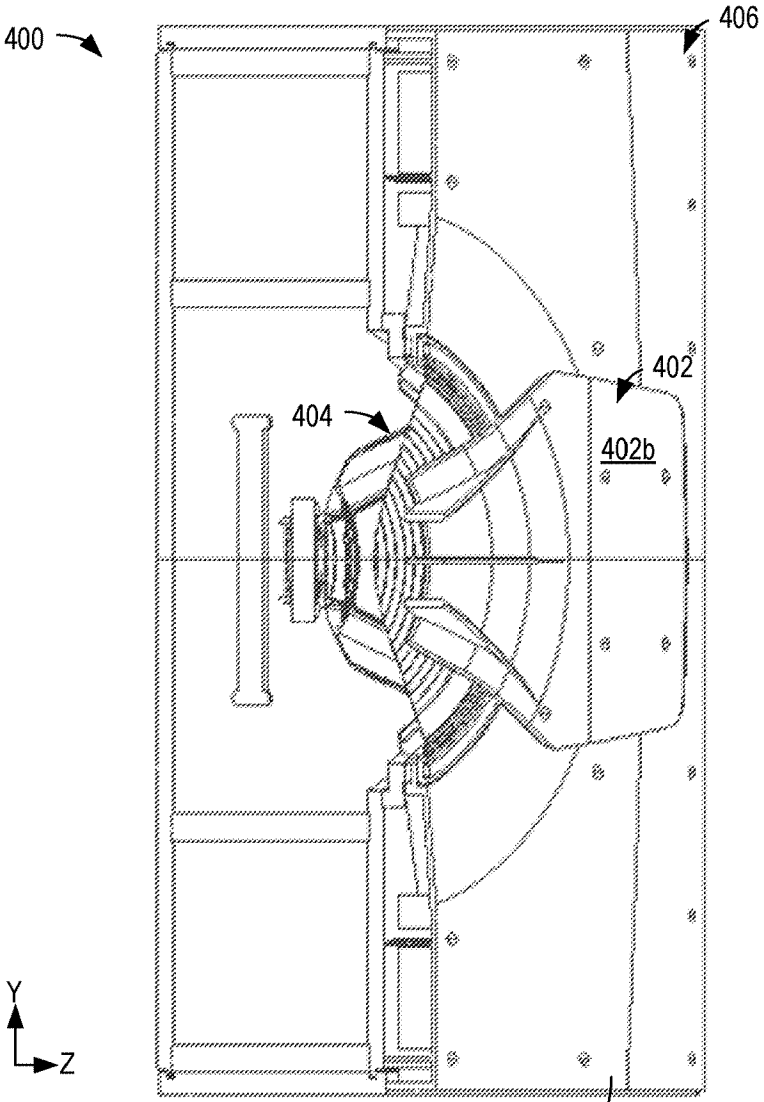
Figure 25:
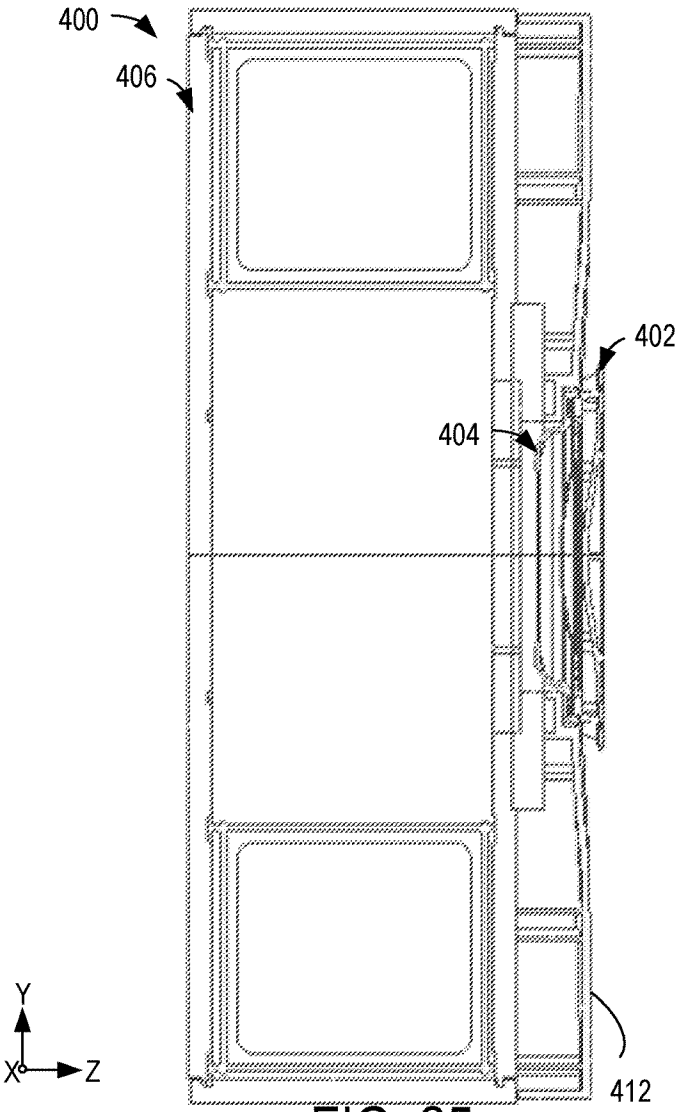
Figure 24:
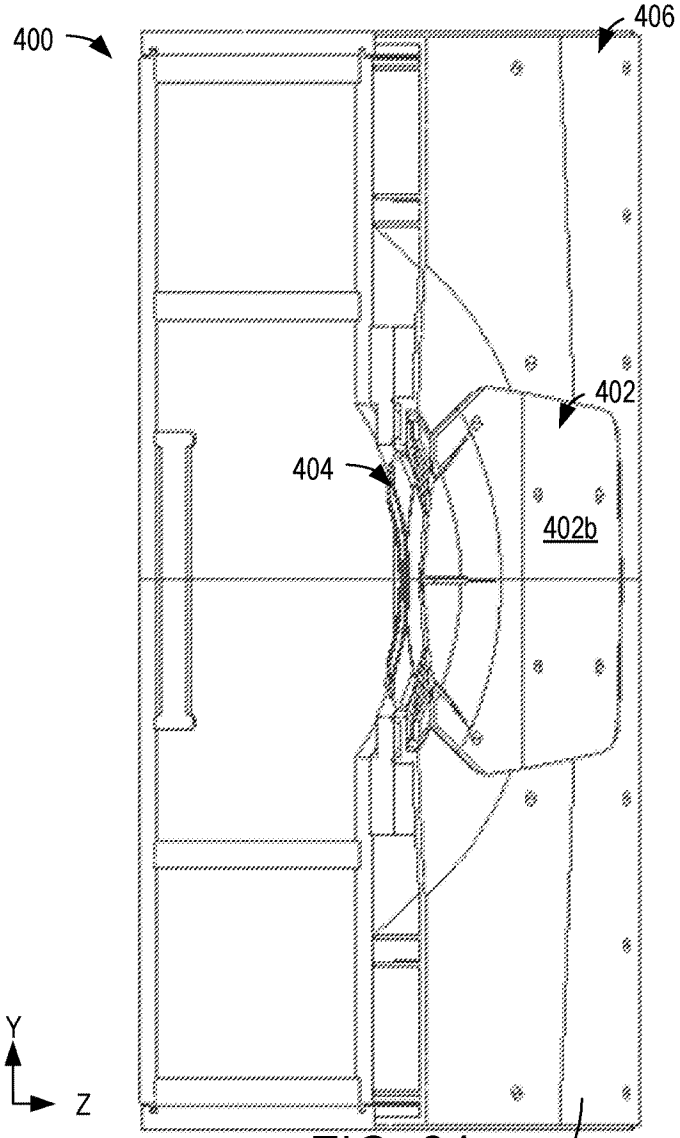

FIGS. 10-17 show different horizontal sectional views of the loudspeaker 400 of FIG. 4 (e.g., taken across planes formed by the x-axis and z-axis at various heights [locations on the y-axis] relative to the loudspeaker), and FIGS. 18-25 show different vertical sectional views of the loudspeaker 400 of FIG. 4 (e.g., taken across planes formed by the y-axis and z-axis at various widths [locations on the x-axis] relative to the loudspeaker). FIGS. 10 and 11 show a projection and top sectional view, respectively, taken at a first height. FIGS. 12 and 13 show a projection and top sectional view, respectively, taken at a second height. FIGS. 14 and 15 show a projection and top sectional view, respectively, taken at a third height, and FIGS. 16 and 17 show a projection and top sectional view, respectively, taken at a fourth height. FIGS. 18 and 19 show a projection and side sectional view, respectively, taken at a first width. FIGS. 20 and 21 show a projection and side sectional view, respectively, taken at a second width. FIGS. 22 and 23 show a projection and side sectional view, respectively, taken at a third width. FIGS. 24 and 25 show a projection and side sectional view, respectively, taken at a fourth width.

In FIG. 12, the sectional view shows an insulation bed 1200. As described above, the insulation bed 1200 may absorb energy that is trapped under the aperture frame during operation of the woofer. For example, the insulation bed 1200 may dampen acoustical waves propagating in a direction toward a rear of the loudspeaker 400 (e.g., an end of the loudspeaker 400 opposite to front surface 412 in a direction of the z-axis). The insulation bed may include one or more chambers or pathways for collecting the energy and components and/or materials for absorbing the energy. In this way, the aperture frame is able to diffuse the symmetric build up of rim and modal energy, mitigate edge diffraction in the plane of operation, and soften the effect of screen reflection energy back toward the loudspeaker.

Figure 26:
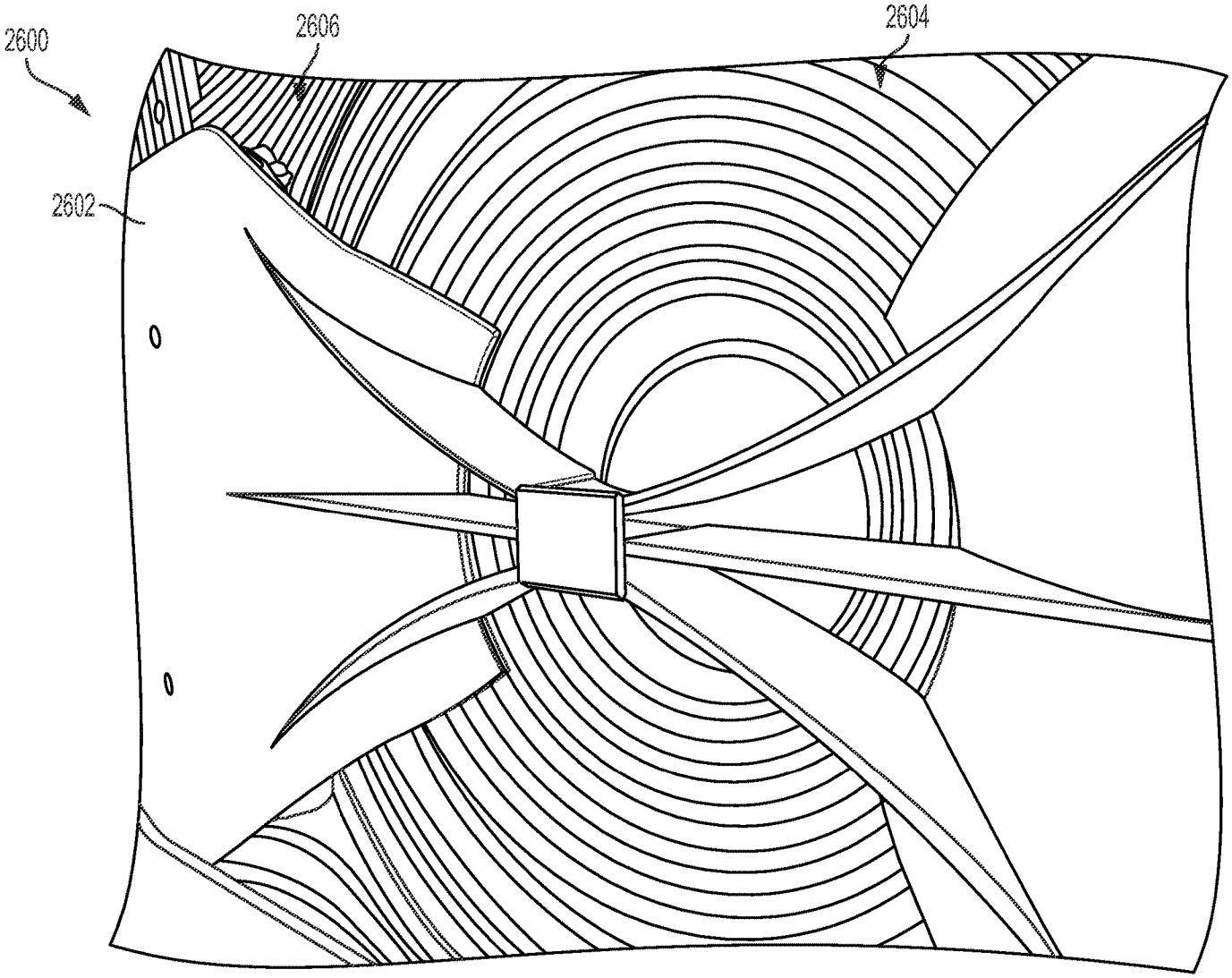
FIG. 26 shows a detail view of an example loudspeaker including an aperture frame in accordance with one or more embodiments of the present disclosure.

FIG. 26 shows a detail view of an example loudspeaker 2600 including an aperture frame 2602 positioned over a radiating surface of a woofer 2604. As shown therein, the aperture frame is attached to a housing around a circumferential edge 2606 of the woofer and extends toward an interior of the housing along a curvature of the woofer 2604.

Figure 27:
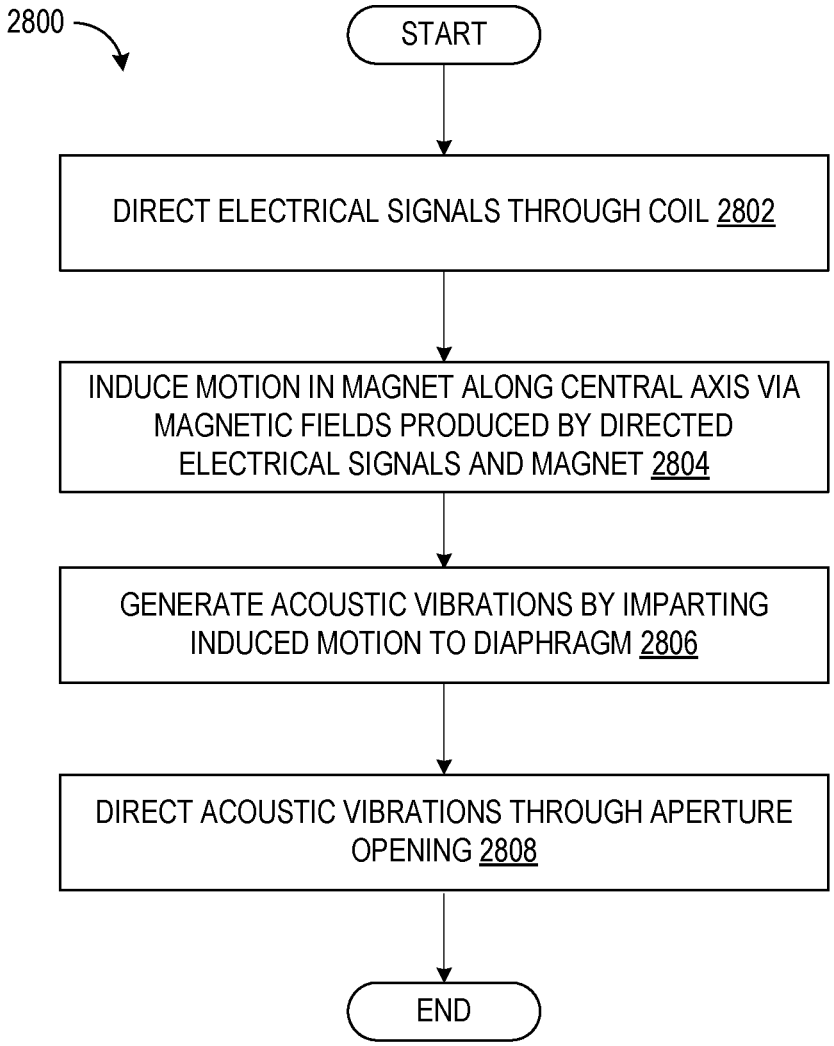
FIG. 27 is a flowchart of a method for driving a loudspeaker in accordance with one or more embodiments of the present disclosure.

FIG. 27 shows a flowchart illustrating a method 2800 for driving a loudspeaker having an aperture frame in accordance with embodiments of the present disclosure is shown. Loudspeakers 100 shown by FIG. 1, loudspeaker 400 shown by FIGS. 4-25, and loudspeaker 2600 shown by FIG. 26 may be driven according to method 2800, in some examples. However, method 2800 may also apply to other loudspeakers having aperture frames similar to those described above (e.g., aperture frame 106, aperture frame 402, etc.).

At 2802, method 2800 includes directing electrical signals to a coil of the loudspeaker (e.g., voice coil). At 2804, the method includes inducing motion in a permanent magnet of the loudspeaker along a central axis. For example, the permanent magnet may be a component of a woofer of the loudspeaker, and inducing motion in the permanent magnet may include moving the permanent magnet along a central axis of the woofer (e.g., an axis intersecting a center of the woofer, positioned along a direction of extension of the woofer and encircled by a circumferential edge of the woofer, such as circumferential edge 416 described above). In one example, the central axis may be parallel to the z-axis described above with reference to FIGS. 4-25. Particularly, magnetic fields arising from directed electrical signals propagating through the coil portions interact with the magnetic field emanating from the permanent magnet to induce motion in the magnet along the central axis. Induced magnet motion may be constrained to the central axis via a linear bearing, for example. The linear bearing may include a shaft embedded in a loudspeaker housing, with a sleeve in sliding contact with the shaft and coupled to the magnet.

At 2806, the method includes generating acoustic vibrations by imparting induced motion in the magnet to a diaphragm in the loudspeaker. Such vibrations may be accomplished by conveying induced motion magnet to a coupler affixed to the magnet, and conveying this motion to the diaphragm via its connection to the coupler. In this manner, the diaphragm may vibrate and thus produce acoustic vibrations responsive to the electrical signals applied to the dual coils. At 2808, the method includes directing the acoustic vibrations through the aperture opening to an environment of the loudspeaker. For example, the acoustic vibrations (e.g., acoustic waves) may travel outward (e.g., in a direction away from an interior and a rear of the loudspeaker) through open sectors (e.g., openings, such as topmost annular sector 490, bottommost annular sector 492, and central circular region 494) formed by the aperture frame of the loudspeaker. In some examples, the acoustic vibrations may travel outward through the open sectors and around a plurality of fins formed by a bridge of the aperture frame (e.g., first fin 470, second fin 472, third fin 474, fourth fin 476, fifth fin 478, and sixth fin 480 of bridge 408 shown by FIG. 4 and described above). By directing the acoustic vibrations through the aperture opening (e.g., through the open sectors and around the plurality of fins) in the configuration described above, the effect of the wavelength-to-device size ratio on the acoustical vibrations (as described above) may be reduced.

The above-described loudspeaker systems may reduce the distortion of sound output in a loudspeaker system by employing an aperture frame that diminishes the effect of the wavelength-to-speaker size ratio by changing a radiation shape of sound exiting the speaker. The technical effect of these features is that increased control may be provided over the sound propagation in relation to systems that utilize no aperture frame (or differently-configured aperture frames), resulting in increased sound production efficiency for a given listening area. For example, adjusting the radiation characteristic of output sounds to mimic omnidirectional output reduces sound losses resulting from outputting sounds having wavelengths that approach the sound of the radiating device. The configuration of the aperture frame to follow the curvature of the radiation surface of the loudspeaker (e.g., a woofer diaphragm) also has the technical effect of reducing crossover generated when woofer output interferes with horn (or other speaker) output.

The disclosure also provides for a loudspeaker including an electromagnetic transducer including a diaphragm configured to generate acoustic vibrations, and an aperture frame positioned in front of the diaphragm in a direction of propagation of the acoustic vibrations, the aperture frame covering only a portion of a radiating surface of the diaphragm and having a shape that corresponds to the contours of the diaphragm. In a first example of the loudspeaker, the aperture frame may additionally or alternatively have a shape that maintains uniform spacing between the radiating surface of the diaphragm and a diaphragm-facing surface of the aperture frame as the aperture frame extends from a circumferential edge of the diaphragm toward a center of the diaphragm. A second example of the loudspeaker optionally includes the first example, and further includes the loudspeaker, wherein the aperture frame covers one fourth to one half of a radiating surface of the diaphragm. A third example of the loudspeaker optionally includes one or both of the first and second examples, and further includes the loudspeaker, wherein the aperture frame is mirror symmetric about a vertical and/or horizontal axis. A fourth example of the loudspeaker optionally includes one or more of the first through the third examples, and further includes the loudspeaker, wherein the aperture frame forms a vertical line source type opening over the diaphragm. A fifth example of the loudspeaker optionally includes one or more of the first through the fourth examples, and further includes the loudspeaker, further comprising an insulation bed positioned under a diaphragm-facing surface of the aperture frame, the insulation bed configured to absorb energy collected under the aperture frame. A sixth example of the loudspeaker optionally includes one or more of the first through the fifth examples, and further includes the loudspeaker, wherein the aperture frame forms an aperture opening over the diaphragm, the aperture opening comprising two annular sectors symmetrically opposing one another about a circular region. A seventh example of the loudspeaker optionally includes one or more of the first through the sixth examples, and further includes the loudspeaker, wherein the aperture opening is formed from edges of the aperture frame and a housing of the loudspeaker at a circumferential edge of the diaphragm. An eighth example of the loudspeaker optionally includes one or more of the first through the seventh examples, and further includes the loudspeaker, wherein the diaphragm is included in a woofer. A ninth example of the loudspeaker optionally includes one or more of the first through the eighth examples, and further includes the loudspeaker, further comprising a high frequency horn.

The disclosure also provides for an aperture frame for a loudspeaker, the aperture frame including a substantially mirror-symmetric pair of aperture frame components, each aperture frame component including a base portion coupled to a housing of the loudspeaker, and a sloped portion extending from the base portion toward a center of a diaphragm, the sloped portion curving inward toward an interior of the housing and having a shape corresponding to contours of the diaphragm. In a first example of the aperture frame, each sloped portion of the aperture frame may additionally or alternatively have a shape that maintains uniform spacing between a radiating surface of the diaphragm and a diaphragm-facing surface of the aperture frame as the aperture frame extends from a circumferential edge of the diaphragm toward the center of the diaphragm. A second example of the aperture frame optionally includes the first example, and further includes the aperture frame, wherein the aperture frame covers one third to one half of a radiating surface of the diaphragm. A third example of the aperture frame optionally includes one or both of the first and second examples, and further includes the aperture frame, wherein the aperture frame is mirror symmetric about a vertical and/or horizontal axis. A fourth example optionally includes one or more of the first through the third examples, and further includes the aperture frame, wherein the aperture frame forms a vertical eye opening over the diaphragm. A fifth example of the aperture frame optionally includes one or more of the first through the fourth examples, and further includes the aperture frame, wherein the aperture frame forms an aperture opening over the diaphragm, the aperture opening comprising two annular sectors symmetrically opposing one another about a circular region. A sixth example of the aperture frame optionally includes one or more of the first through the fifth examples, and further includes the aperture frame, wherein the aperture opening is formed from edges of the aperture frame and the housing of the loudspeaker at a circumferential edge of the diaphragm.

The disclosure also provides for a method of driving a loudspeaker having an aperture frame, the aperture frame positioned in front of a diaphragm of the loudspeaker in a direction of propagation of the acoustic vibrations, the aperture frame covering only a portion of a radiating surface of the diaphragm and having a shape that corresponds to the contours of the diaphragm to form an aperture opening over the diaphragm, and the method comprising directing electrical signals to a coil of the loudspeaker, inducing motion in a permanent magnet along a central axis of the loudspeaker, generating acoustic vibrations by imparting induced motion in the magnet to the diaphragm in the loudspeaker, and directing the acoustic vibrations through the aperture opening to an environment of the loudspeaker. In a first example of the method, directing the acoustic vibrations through the aperture opening may additionally or alternatively include directing the acoustic vibrations through a topmost annular sector, bottommost annular sector, and central sector of the aperture opening, the topmost annular sector being positioned opposite to the bottommost annular sector with the central sector positioned therebetween. A second example of the method optionally includes the first example, and further includes the method, wherein directing the acoustic vibrations through the aperture opening includes directing the acoustic vibrations around a plurality of fins coupled to the aperture frame and positioned in front of the radiating surface, the plurality of fins coupled to a central junction positioned in front of a center of the diaphragm.

The description of embodiments has been presented for purposes of illustration and description. Suitable modifications and variations to the embodiments may be performed in light of the above description or may be acquired from practicing the methods. The described systems are exemplary in nature, and may include additional elements and/or omit elements. FIGS. 4-25 are shown to scale, although other relative dimensions may be used, if desired. The subject matter of the present disclosure includes all novel and non-obvious combinations and sub-combinations of the various systems and configurations, and other features, functions, and/or properties disclosed.

FIGS. 1 and 4-26 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical (e.g., y-) axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

As used in this application, an element or step recited in the singular and proceeded with the word "a" or "an" should be understood as not excluding plural of said elements or steps, unless such exclusion is stated. Furthermore, references to "one embodiment" or "one example" of the present disclosure are not intended to be interpreted as excluding the existence of additional embodiments that also incorporate the recited features. The terms "first," "second," and "third," etc. Are used merely as labels, and are not intended to impose numerical requirements or a particular positional order on their objects. The term "substantially," as in "substantial equal to" for example, is used to account for tolerances due to mechanical precision considerations, and may refer to a value within 5% of the property being modified by the term "substantially." The following claims particularly point out subject matter from the above disclosure that is regarded as novel and non-obvious.

The invention claimed is:

1. A loudspeaker comprising:

an electromagnetic transducer including a diaphragm configured to generate acoustic vibrations; and an aperture frame positioned in front of the diaphragm in a direction of propagation of the acoustic vibrations, the aperture frame covering only a portion of a radiating surface of the diaphragm and having a shape that corresponds to contours of the diaphragm, wherein the aperture frame comprises a first aperture frame component and a second aperture frame component that are spaced apart from one another and only extend partway towards a center of the diaphragm, wherein each of the first aperture frame component and the second aperture frame component includes a base portion and a sloped portion, the sloped portions positioned between the base portions, wherein a first arc is formed by an edge at which the base portion and the sloped portion of the first aperture frame component meet, wherein a second arc is formed by an edge at which the base portion and the sloped portion of the second aperture frame component meet, wherein the first arc and the second arc are curved concentrically with a circumferential edge of the diaphragm, and wherein a distance from a center of the first arc to a center of the second arc is greater than a distance from ends of the first arc to ends of the second arc.

2. The loudspeaker of claim 1, wherein the aperture frame has a shape that maintains uniform spacing between the radiating surface of the diaphragm and a diaphragm-facing surface of the aperture frame as the aperture frame extends from the circumferential edge of the diaphragm toward the center of the diaphragm.

3. The loudspeaker of claim 1, wherein the sloped portions curve inward towards an interior of a housing of the loudspeaker.

4. The loudspeaker of claim 1, wherein the aperture frame is mirror symmetric about a vertical axis and/or a horizontal axis.

5. The loudspeaker of claim 1, wherein the aperture frame forms a vertical line source type opening over the diaphragm.

6. The loudspeaker of claim 1, further comprising an insulation bed positioned under a diaphragm-facing surface of the aperture frame, the insulation bed configured to absorb energy collected under the aperture frame.

7. The loudspeaker of claim 1, wherein the aperture frame forms an aperture opening over the diaphragm, the aperture opening comprising two annular sectors symmetrically opposing one another about a circular region.

8. The loudspeaker of claim 7, wherein the aperture opening is formed from edges of the aperture frame and a housing of the loudspeaker at the circumferential edge of the diaphragm.

9. The loudspeaker of claim 1, wherein the diaphragm is included in a woofer.

10. The loudspeaker of claim 1, further comprising a high frequency horn.

11. An aperture frame for a loudspeaker, the aperture frame comprising:

a mirror-symmetric pair of aperture frame components, each aperture frame component including:

a base portion coupled to a housing of the loudspeaker;

a sloped portion extending from the base portion toward a center of a diaphragm, the sloped portion curving inward toward an interior of the housing and having a shape corresponding to contours of the diaphragm; and an edge at which the base portion and the sloped portion meet that curves concentrically with a circumferential edge of the diaphragm, wherein the edge is concave relative to the center of the diaphragm, wherein the pair of aperture frame components is spaced apart from one another and only extends partway towards the center of the diaphragm, and wherein the sloped portions of the pair of aperture frame components are positioned between the base portions of the pair of aperture frame components.

12. The aperture frame of claim 11, wherein each sloped portion of the pair of aperture frame components has a shape that maintains uniform spacing between a radiating surface of the diaphragm and a diaphragm-facing surface of the aperture frame as the aperture frame extends from the circumferential edge of the diaphragm toward the center of the diaphragm.

13. The aperture frame of claim 11, wherein the aperture frame covers one third to one half of a radiating surface of the diaphragm.

14. The aperture frame of claim 11, wherein each sloped portion includes an end opposite the edge that curves concentrically with the circumferential edge of the diaphragm.

15. The aperture frame of claim 11, wherein the sloped portions overlap a front of the diaphragm.

16. The aperture frame of claim 11, wherein the aperture frame forms an aperture opening over the diaphragm, the aperture opening comprising two annular sectors symmetrically opposing one another about a circular region.

17. The aperture frame of claim 16, wherein the aperture opening is formed from edges of the aperture frame and the housing of the loudspeaker at the circumferential edge of the diaphragm.

18. A method of driving a loudspeaker having an aperture frame, the aperture frame positioned in front of a diaphragm of the loudspeaker in a direction of propagation of acoustic vibrations, the aperture frame covering only a portion of a radiating surface of the diaphragm and having a shape that corresponds to contours of the diaphragm to form an aperture opening over the diaphragm, the method comprising:

directing electrical signals to a coil of the loudspeaker;

inducing motion in a permanent magnet along a central axis of the loudspeaker;

generating acoustic vibrations by imparting induced motion in the magnet to the diaphragm of the loudspeaker; and directing the acoustic vibrations through the aperture opening to an environment of the loudspeaker, wherein the aperture frame comprises a first frame component and a second frame component that are spaced apart from one another and only extend partway towards a center of the diaphragm, wherein each of the first frame component and the second frame component includes a base portion and a sloped portion, the sloped portions positioned between the base portions, wherein an edge at which the base portion and the sloped portion of the first frame component meet forms a first curve, the first curve parallel to a first portion of a circumferential edge of the diaphragm, where the first portion of the circumferential edge of the diaphragm is positioned underneath the first frame component, and wherein an edge at which the base portion and the sloped portion of the second frame component meet forms a second curve, the second curve parallel to a second portion of the circumferential edge of the diaphragm, where the second portion of the circumferential edge of the diaphragm is positioned underneath the second frame component.

19. The method of claim 18, wherein directing the acoustic vibrations through the aperture opening includes directing the acoustic vibrations through a topmost annular sector, a bottommost annular sector, and a central sector of the aperture opening, the topmost annular sector being positioned opposite to the bottommost annular sector with the central sector positioned therebetween.

20. The method of claim 18, wherein directing the acoustic vibrations through the aperture opening includes directing the acoustic vibrations around a plurality of fins coupled to the aperture frame and positioned in front of the radiating surface of the diaphragm, the plurality of fins coupled to a central junction positioned in front of the center of the diaphragm.

* * * * *